US007048121B2

(12) United States Patent
Yamamoto et al.

(10) Patent No.: US 7,048,121 B2
(45) Date of Patent: May 23, 2006

(54) SEALED CASE

(75) Inventors: Taro Yamamoto, Minami-Ashigara (JP); Kozo Tanaka, Minami-Ashigara (JP); Taro Shimokochi, Minami-Ashigara (JP); Jun Sada, Tokyo (JP); Makoto Yamaguchi, Tokyo (JP); Hiroyuki Mizuma, Tokyo (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 134 days.

(21) Appl. No.: 10/246,742

(22) Filed: Sep. 19, 2002

(65) Prior Publication Data

US 2003/0052029 A1 Mar. 20, 2003

(30) Foreign Application Priority Data

Sep. 20, 2001 (JP) ..... 2001-287640
Sep. 21, 2001 (JP) ..... 2001-288262

(51) Int. Cl.
*B65D 85/66* (2006.01)

(52) U.S. Cl. ..... 206/395; 206/397; 206/413

(58) Field of Classification Search ..... 206/395, 206/397, 413, 415, 416, 398; 220/8
See application file for complete search history.

(56) References Cited

U.S. PATENT DOCUMENTS 3,481,457 A * 12/1969 Overton et al. ..... 206/395
3,845,894 A 11/1974 Merlin
4,212,389 A * 7/1980 Robbins ..... 242/348.4
4,823,956 A * 4/1989 Belisle ..... 206/523
4,903,835 A * 2/1990 Beery ..... 242/588.5
5,056,662 A * 10/1991 Lasenby et al. ..... 206/395
5,413,221 A * 5/1995 Mizuno ..... 206/397
5,868,339 A * 2/1999 Ruysink ..... 242/348.4
5,941,476 A * 8/1999 Copass ..... 242/588.6
6,698,589 B1 * 3/2004 Johnson ..... 206/391

FOREIGN PATENT DOCUMENTS

EP 0 369 346 A1 5/1990
GB 1120028 A 7/1968

OTHER PUBLICATIONS

Patent Abstracts of Japan—2002172717 (2002).
Patent Abstracts of Japan—02258546 (1990).
European Search Report dated Jul. 24, 2003.

* cited by examiner

*Primary Examiner*—Shian T. Luong
(74) *Attorney, Agent, or Firm*—Sughrue Mion, PLLC

(57) ABSTRACT

A sealed case includes an elongated trunk member including an overlapped part made by overlapping parts of an inside end portion and an outside end portion apart from each other in a vertical axis direction of a sheet material and first and second end portions each provided with an opening and apart from each other. The overlapped part has a fixing area to fix the inside and outside end portions. First and second cover members are fixed to the first and second open end portions of the trunk member, closing the openings.

14 Claims, 11 Drawing Sheets

SEALED CASE

CROSS-REFERENCE TO RELATED APPLICATIONS

This application is based upon and claims the benefit of priority from the prior Japanese Patent Applications No. 2001-287640, filed Sep. 20, 2001; and No. 2001-288262, filed Sep. 21, 2001, the entire contents of both of which are incorporated herein by reference.

BACKGROUND OF THE INVENTION

1. Field of the Invention

The present invention relates to a sealed case, and in particular to a sealed case comprising an elongated cylindrical trunk member with open end portions, a first cover member to close one open end portion of the trunk member, and a second cover member to close the other open end portion of the trunk member.

2. Description of the Related Art

Conventionally, a sealed case of the above-mentioned structure is made of a thick paper blank shaped as predetermined, for example. A blank is desirably as thin as possible to reduce the manufacturing cost of such a sealed case. However, use of a thin blank involves a rigidity problem, and limits the usage.

BRIEF SUMMARY OF THE INVENTION

An object of the present invention is to provide a sealed case with excellent rigidity made of relatively thin material, or a blank.

In order to achieve the above object, one aspect of the present invention relates to a sealed case comprising an elongated trunk member including an overlapping part made by overlapping at least a parts of an inside end portion and an outside end portion apart from each other in a vertical axis direction of a sheet material having a vertical axis and a horizontal axis crossing the vertical axis, and first and second end portions each provided with an opening and apart from each other in a horizontal axis direction, and the overlapped portion having a fixing area to fix the inside and outside end portions;

first and second cover members made of sheet material and fixed to the first and second open end portions of the trunk member, closing the openings of the open end portions; and a tongue member which is provided at the outside end portion of the trunk member and exposed to an outside, and when a tensile force is applied, releases the fixing of the outside and inside end portions and partially releases the fixing of the first and second open end portions and the first and second cover members, thereby unsealing the sealed case;

each of the first and second cover members including a main part having the substantially same shape and size as that of the cross section of the opening of the trunk member, and a rim provided in the circumference of the main part; and the main part of the cover member being located in each end portion of the trunk member, and the rim of the cover member is fixed to an inside surface of the end portion in a surface contact manner.

The overlapped part of the trunk member may be sealed in an air-tight manner.

The sealing may be made by a sealing tape which covers an end-face, a part of the inside and a part of the outside of the inside end portion, in the overlapped part of the both end portions of the material.

At least one of the part covering a part of the outside of the inside end portion and the inside of the outside end portion may be adjusted to obtain a desired strength of the fixing.

The part of the sealing tape covering the outside of the end portion may be fixed to the outside end portion along the horizontal axis all over the trunk material width.

The fixing may be made by heat sealing.

The overlapped part of the trunk member may be formed by heat sealing along the both end portions, and the seat sealing may be adjusted to obtain a desired fixing strength.

The fixing may be made so that the part corresponding to the tongue member is located closer to a tip of the tongue member than the other parts.

The each rim of the first and second cover members, or the internal circumference of the end portion of the trunk member, may be adjusted to obtain a desired heat sealing strength of each rim of the first and second cover members with respect to the inner circumference of the end portion of the desired length part adjoining the outside end portion.

The tongue member may be formed separately from the sheet material of the trunk member, and then may be fixed to the outside end portion of the trunk member.

The tongue member may be made of different sheet material from the material of the trunk member, and then may be fixed to the outside end portion of the trunk member.

The tongue member may be made of the same sheet material as the material, and may be fixed to the outside end portion.

The sheet material may be laminate of thick paper and metal or inorganic matter evaporated layer.

The trunk member is preferably closed by the second cover member after an article to be contained in the case is contained in the case, after the first opening is closed by the first cover member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

FIG. 6A and FIG. 6B illustrate a sealed case according to a second embodiment of the present invention, in which FIG. 6A is a perspective view before unsealing, and FIG. 6B is a perspective view after unsealing;

FIG. 10A, FIG. 10B and FIG. 10C are sectional views of the lamination of substance usable as a sealed case of the present invention, in which FIG. 10A shows the lamination of a trunk plate, FIG. 10B shows the lamination of a sealing cover, and FIG. 10C shows the lamination of a moisture-proof film;

DETAILED DESCRIPTION OF THE INVENTION

First, a sealed case according to a first embodiment of the present invention will be explained with reference to FIGS. 1 to 4 of the accompanying drawings.

Figure 1A:
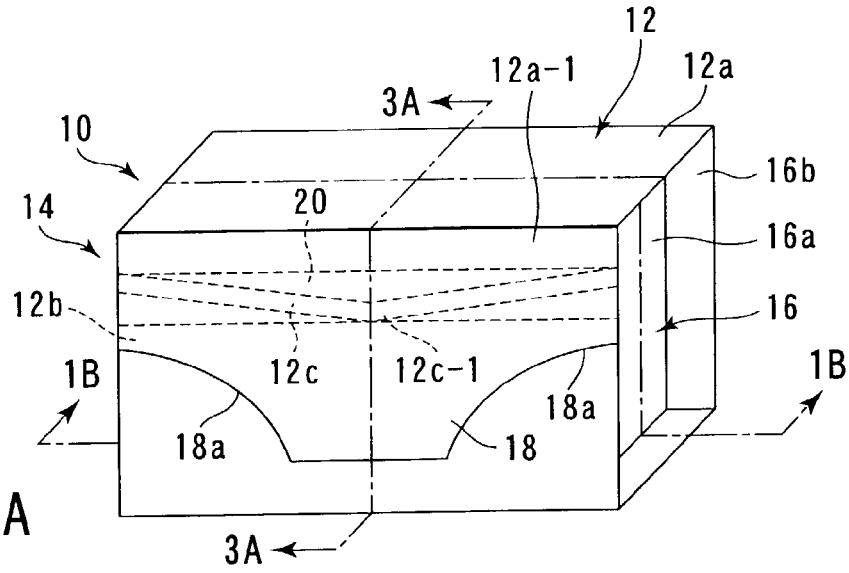
FIG. 1A is a schematic perspective view of a sealed case according to a first embodiment of the present invention.
Figure 1B:
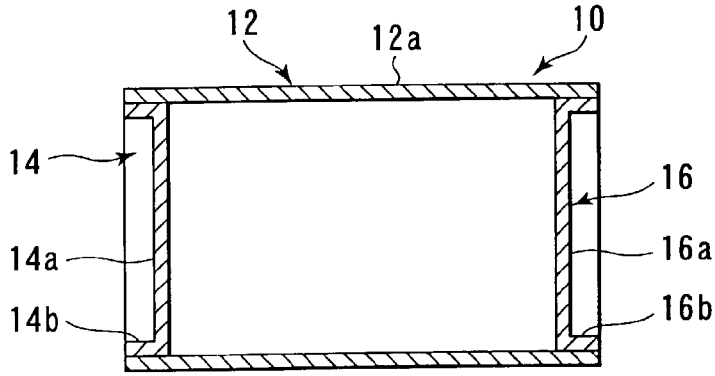
FIG. 1B is a schematic longitudinal sectional view taken along the line 1B—1B of FIG. 1A.

As shown in FIGS. 1A and 1B, a sealed case 10 according to a first embodiment of the invention comprises an elongated trunk member 12, a first cover or member 14 which is fixed to one end portion or a first end portion of the trunk member 12 and closes an opening, a second cover member 16 which is fixed to the other end portion or a second end portion of the trunk member 12 and closes an opening, and a tongue or pick-up member 18 which is provided in the trunk member 12 and exposed to the outside.

Figure 2A:
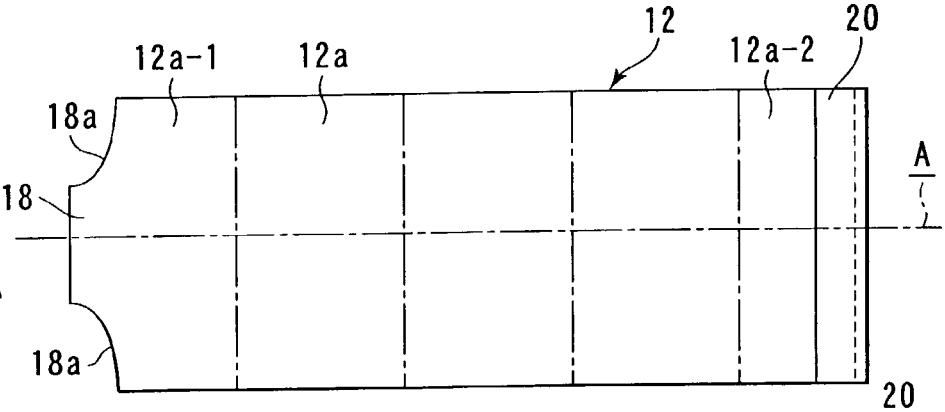
FIG. 2A is a development view of an elongated trunk member of the sealed case of FIG. 1A.

As shown in detail in FIG 2A, said trunk member 12 is made elongated by overlapping both end portions in a longitudinal direction (along the center longitudinal axis A) of a hermetic or airtight laminar material or a blank 12*a*. In this embodiment, these both end portions are fixed each other indirectly at their overlapped part 12*b* (FIG. 1A), but they can also be directly fixed. The indirect fixing will be explained later in detail.

In this first embodiment, the cross section of the trunk member 12 is square, but it may be polygonal, circular or elliptical. That is, the shape is not specified.

Said tongue member 18 is formed to be integral with an outside end portion 12*a*-1 of said both end portions of the blank 12*a*, just like projecting therefrom. When the blank is assembled with the trunk member, the tongue member 18 projects from the edge of the inside end portion 12*a*-2, or the other end of said both end portions, as shown in FIG. 1A. This projection (along the longitudinal axis A) of the tongue member 18 is long enough to permit one finger to be inserted between the tongue member 18 and the inside end portion 12*a*-2 and to pinch the tongue. Both side edges 18*a* of the tongue member between a tip of the tongue member 18 and both side edges (the edges isolated along the horizontal axis orthogonal to the vertical axis A) of the material 12*a* are arc-shaped. This arc-shape is preferably a curve whose radius of curvature gradually increases from the grip member tip toward the side edges of the sheet 12*a*. Such a curve will prevent a crack in the boundary between the central portion of the tongue member which is not secured or fixed to the inside end portion 12*a*-2 and the both end portions which has the side edges 18*a* of the tongue member secured or fixed to the inside end portion, when the tongue member 18 is pinched and pulled outward (vertically and upward against the paper surface in FIG. 1A) in order to unseal the case. When there is no possibility to occur such a crack, the shape of the tongue member is not specified. For instance, when only the central portion of the tongue member projects as in this embodiment, the tongue may project at a right angle or at a certain angle. The central portion is not necessarily be projected. It is permitted to make all edges the same width.

In this embodiment, the tongue member is made in one piece with or integral with the outside end portion 12*a*-1, but it is separated from the material 12*a*, and it can be fixed at an optional position on the outside of the outside end portion 12*a*-1 by heat sealing, adhesive or other known fixing means.

Figure 3A:
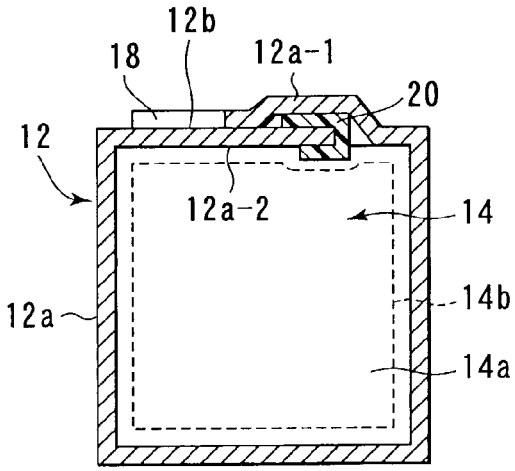
FIG. 3A is a schematic transverse sectional view taken along the line 3A—3A of FIG. 1A.

To enhance the hermeticity in the overlapped part 12*b* of the above-mentioned both end portions 12*a*-1 and 12*a*-2 of the material 12*a*, the end-face of the inside end portion 12*a*-2 is covered by a sealing tape 20 throughout the elongate direction of the trunk member 12 (the width direction of the blank 12*a* or along the horizontal axis). Namely, this sealing tape is wound around the edge portion from the outside near the edge of the inside end portion 12*a*-2 toward the inside passing through the end-face, as shown in FIG. 3A.

The sealing tape 20 preferably shuts off leakage of the air or vapor, which flows even a little into the air penetrative material contained in the sheet 12*a* from the both ends exposed to the outside space in the longitudinal direction of the trunk member 12 in the inside end portion 12*a*-2, from the end-face along the circumferential direction of the trunk member 12 into the inside space of the trunk member.

Although the sealing tape 20 indirectly fixes the outside (outer surface) of the inside end portion 12*a*-2 and the inside (inner surface) of the outside end portion 12*a*-1 of the trunk member 12, which are opposite to each other, the outside and inside may be directly fixed (without using a sealing tape). It is also permitted to mix direct and indirect fixings. Heat sealing can be used to fix the sealing tape 20 and/or the outside of the inside end portion 12*a*-2 and the inside of the outside end portion 12*a*-1. If the degree of sealing demanded by the sealed case 10 is low, adhesive may be used. The fixing may be continuously or discontinuously made over all area in the longitudinal side of the trunk member.

Figure 5A:
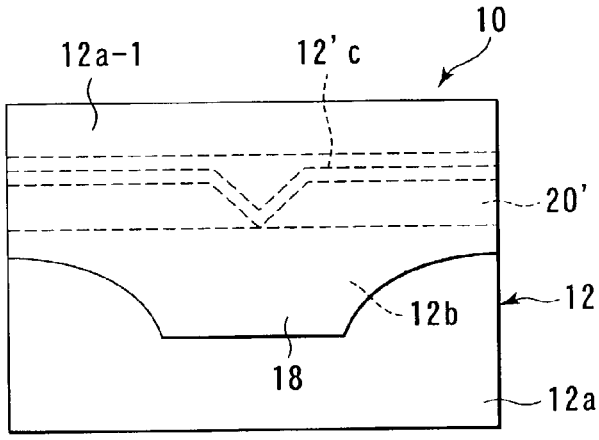
FIG. 5A and FIG. 5B are schematic views showing different modifications of the fixing of both end portions at the overlapped part of the trunk member material of the sealed case according to a first embodiment of the present invention.
Figure 5B:
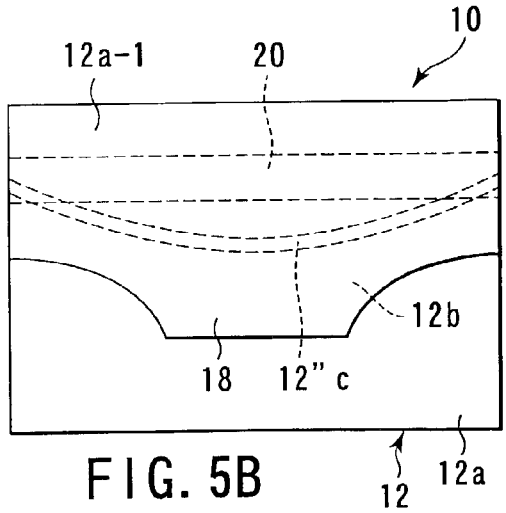

The pattern of above fixing part is shaped like a strip region inclining so that the center portion 12*c*-1 comes close to the tongue member 18 in the longitudinal direction of the trunk member as indicated by dotted lines 12*c* in FIG. 1A. However, the shape is not limited by this pattern. It may be shaped as shown in FIG. 5A and FIG. 5B later. The shape is not specified.

With the shape shown in FIG. 1A, when a tensile force is applied to the tongue member 18, the force is first concentrated on the portion 12*c*-1 most close to the end of the tongue member 18 in the fixing area 12*c*, and when the force is continuously applied to the tongue, the fixing will be easily released toward the portions on both sides of the portion 12*c*-1.

When the fixing is released using the tongue member 18, the fixing strength of the outside of the sealing tape 20 or the inside of the outside end portion 12*a*-1 can be adjusted, so that the sealing tape 20 and/or the outside of the inside end portion 12*a*-2 and the inside of the outside end portion 12*a*-1 can be more easily released. If the heat sealing is used for the above-mentioned fixing, the fixing strength of the heat sealing is adjusted.

When a tensile force is applied to the tongue member 18, the fixing of the outside end portion 12*a*-1 to the inside end portion 12*a*-2 at the overlapped part 12*b* can be released, regardless of whether the fixing is indirect as explained above or direct by various known means not affecting the hermeticity of the material 12*a* by overlaying the outside end portion 12*a*-1 on the inside end portion 12*a*-2. Moreover, by adjusting the fixing strength, the fixing strength can be always controlled to a desired level.

Said first cover member 14 is made of a sheet or laminar material with hermeticity or air tightness, and includes a flat main part 14*a* which is made in the substantially same shape and size as the cross section of the opening at one end of the trunk member 12, and a rectangular cylindrical projection or rim 14*b* which is provided in being bent 90° against the main part in the circumference of the main part 14*a*. The main part 14*a* is disposed in the opening at one open end portion of the trunk member 12, and the rectangle projection 14*b* is fixed to the inner circumference of said one end. This fixing is made so that the projection 14*b* is located outside of the trunk member against the main part, as shown in FIG. 1B. The projection 14*b* projects all over the circumference of the main part 14*a*, but the projection can be limited only to the necessary portion or portions of the circumference.

Although the fixing of the projection 14*b* of the first cover member 14 to the inner circumference of one open end portion of the trunk member 12 is made by the continuous heat sealing all over said inner circumference in this embodiment, an adhesive can be used instead of the heat sealing depending on the degree of hermeticity required as the sealed case 10, and the fixing can be made discontinuously to said inner circumference using adhesive or heat sealing.

The second cover member 16 has the same structure as the first cover member 14, having a main part 16*a* and a projection or rim 16*b* integrally provided around the main part 16*a*, and closing the other open end portion of the trunk material 12.

In the inner circumference of said both end portions of the trunk member 12 or in the projections 14*b*, 16*b* of said both cover members, the part adjoining the outside end portion 12*a*-1 of the overlapped part 12*b* in the material 12*a* of the trunk member 12 is adjusted to obtain a desired fixing strength.

Figure 3B:
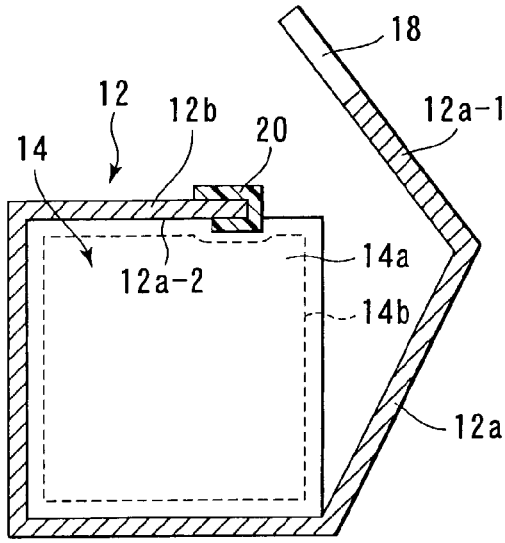
FIG. 3B is a transverse sectional view of the sealed case of FIG. 3A, being unsealed.

When opening the sealed case 10 comprising a trunk member 12 made cylindrical of hermetic laminar material 12*a* and cover members 14, 16 closing the both open end portions of the trunk member, pinch the tongue member 18 and pull it out from the case. As a result, the fixing of the outside end portion 12*a*-1 to the inside end portion 12*a*-2 of the case is released first, and if the outside of the sealing tape 20 of the inside end portion 12*a*-2 is fixed to the inside of the outside end portion 12*a*-1, this fixing is then released, and finally the fixing of at least the part adjoining the outside end portion 12*a*-1 of the projections 14*b*, 16*b* of the cover members located at both end portions of the trunk member 12 is released, as shown in FIG. 3B.

Further, as described above, these fixings can be adjusted to a desired fixing strength, and even if the degree of sealing demanded by the case 10 is severe and the fixing is made tight, a relatively small tensile force to the tongue member 18 is required when releasing the fixing or when opening the sealed case. Thus, the sealed case 10 of this embodiment can be easily opened by women, aged or children except infants who are considered to have less power compared to adult men.

Figure 4:
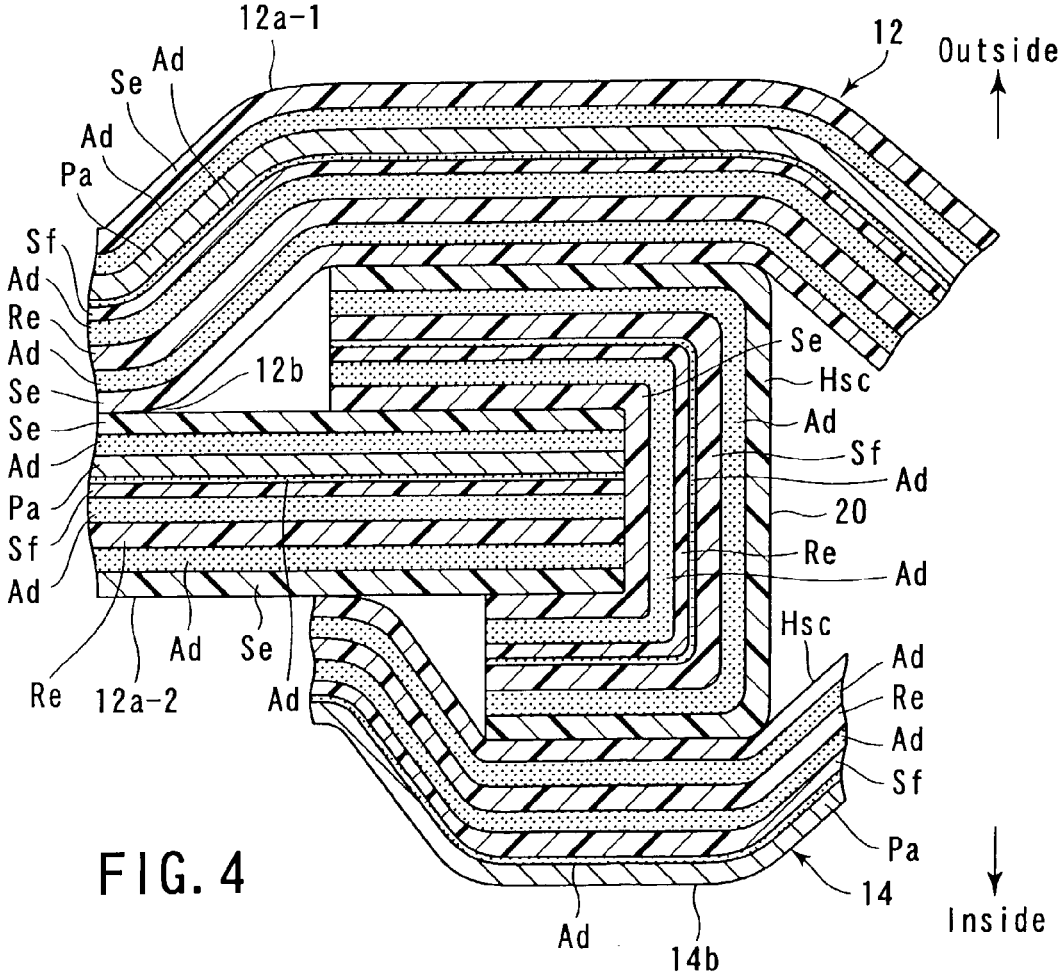
FIG. 4 is a magnified transverse sectional view of an overlapped part of the elongated trunk member material of the sealed case, together with a sealing tape provided on said overlapped part and a rim of a first cover member adjacent to said overlapped part.

Referring now to FIG. 4, description will be given on the examples of the sheet materials of the members of the above-mentioned first embodiment: the hermetic laminar material 12*a* of the trunk member 12, the hermetic laminar material of the first and second cover members 14, 16, and the material of the sealing tape 20.

In the above-mentioned first embodiment, the sheet material 12*a* is made of paper, preferably thick paper as a base material Pa, and sealant Se is laminated thereon via an adhesive layer Ad. The adhesive layer Ad can be formed by urethane group adhesive or polyolefin for lamination such as polyethylene. Sealant Se can be formed by polyethylene or polyolefin such as polypropylene.

The underside of the paper base material Ps is laminated by an adhesive layer Ad, seal film Sf, adhesive layer Ad, reinforcement film Re, adhesive layer Ad and sealant Se in this sequence. The seal film Sf can be formed by various known hermetic materials depending on the degree of demanded hermeticity. In this embodiment, it is formed by an inorganic material evaporated film or an aluminum film. For example, it is formed by evaporating inorganic oxide represented by aluminum oxide or silicon oxide on a base material such as polyester film to a thickness of 20–150 nanometers by vacuum evaporation or the like. Such a seal film Sf is airtight hermetic (gas-barrier or gas-tight). The adhesive layer Ad and sealant Se are as explained above. The reinforcement film Re is a film made of nylon or polyethylene terephtalate.

From the above description, it can be understood that the sheet material 12*a* of this embodiment is made by sequentially laminating sealant Se, adhesive layer Ad, paper base material Pa, adhesive layer Ad, seal film Sf, adhesive layer Ad, reinforcement film Re, adhesive layer Ad and sealant Se from outside to inside.

As shown in FIG. 4, the sealant Se of the inside of the outside end portion 12*a*-1 is adjacent to the sealant Se of the outside of the inside end portion 12*a*-2 in the trunk member 12. Therefore, when fixing the inside of the outside end portion 12*a*-1 directly to the outside of the inside end portion 12*a*-2 as stated before, they can be fixed by various known means, adhesive and heat sealing, for example, not affecting the hermeticity of the sheet 12*a* when overlaying the sealant Se of the outside end portion 12*a*-1 on the sealant Se of the inside end portion 12*a*-2.

Said reinforcement film Re is omissible together with one adhesive layer Ad adjacent thereto, depending on the application purpose of the sealed case 10.

The laminar material having the hermeticity common to the cover members 14, 16 of this embodiment is formed by sequentially laminating paper base layer Pa, adhesive layer Ad, seal film Sf, adhesive layer Ad, reinforcement film Re, adhesive layer Ad and seat seal strength control film Hsc in this sequence from the outside opposite to the inner circumference of the end of the trunk member 12 toward the inside facing to said inner circumference, as shown magnified in FIG. 4.

The heat seal strength control film Hsc has been well known as a polyolefin group releasing agent or a releasing agent for coating such as hot melt and heat seal lacquer.

The cross section of the cover member 14 shown in FIG. 4 is the cross section of the projection 14*b* fixed to the inner circumference of one end of the trunk member 12. In the cross section of the main part 14*a*, the paper base layer Pa is disposed at the outermost side in the opening of one open end portion of the trunk member 12, and the heat seal strength control film Hsc is disposed at the innermost side.

Also, in the laminar material with hermeticity common to the cover members 14, 16, the reinforcement film Re is omissible together with one adjacent adhesive layer Ad, depending on the application purpose of the sealed case 10.

In this embodiment, the projected strips 14*b* and 16*b* are fixed to the sealant Se of the inner circumference of the end of the trunk member 12 by heat sealing via the heat seal strength control film Hsc facing to said inner circumference.

The sealing tape 20 is formed by laminating heat seal strength control film Hsc, adhesive layer Ad, seal film Sf, adhesive layer Ad, reinforcement film Re, adhesive layer Ad and sealant Se in this order, from the end-face of the inside end portion 12*a*-2 of the trunk member 12 to the inside and upper side adjoining this end-face.

Also, in the sealing tape 20, the reinforcement film Re is omissible together with one adjacent adhesive layer Ad, depending on the application purpose of the sealed case 10.

In the sealing tape 20 of this embodiment, the inside sealant Se is fixed by heat sealing with respect to the adjacent part of the end of the inside end portion 12*a*-2 of the trunk member 12 and the outside sealant Se and the adjacent part of the inside sealant Se and said end-face.

In the sealing tape 20, as shown in FIG. 4, the adjacent part of said end-face of the outside of the sealing tape 20 is fixed to the inside sealant Se of the outside end portion 12*a*-1 of the trunk member 12 via the outside heat seal strength control film Hsc. Similarly, the adjacent part of said end-face of said inside of the sealing tape 20 is fixed to the inside heat seal strength control film Hsc of the projections 14*b*, 16*b* of the cover members 14, 16 via the outside heat seal strength control film Hsc.

The laminar material 12*a* with hermeticity and/or air tightness of the trunk member 12 is formed by laminating sealant Se, adhesive layer Ad, paper base material Ps, adhesive layer Ad, seal film Sf, adhesive layer Ad, reinforcement film Re, adhesive layer Ad and heat seal strength control film Hsc in this order from the outside toward the inside. When the inside of the outside end portion 12*a*-1 is fixed directly to the outside of the inside end portion 12*a*-2 by heat sealing in the overlapped part 12*b* of the trunk member 12, the heat seal strength control film Hsc of the inside of the outside end portion 12*a*-1 can be directly fixed to the sealant Se of the outside of the inside end portion 12*a*-2. In this case, also, the reinforcement film Rf is omissible together with one adjacent adhesive layer Ad, depending on the application purpose of the sealed case 10.

In this modification, the laminar material of the first and second cover members 14 and 16 is formed by laminating a paper base layer Pa, adhesive layer Ad, seal film Sf, adhesive layer Ad, reinforcement film Re, adhesive layer Ad and sealant Se in this order, from the outside opposite to the inner circumference of the end of the trunk member 12 toward the inside facing said inside. Therefore, since the cross section of the material of the first cover member 14 shown in FIG. 4 is the cross section of the projection 14*b* fixed to the inner circumference of one end of the trunk member 12 in the first cover member 14, the paper base layer Pa is disposed outermost in the opening of one open end portion of the trunk member 12 in the cross section of the main part 14*a*, and the sealant Se is disposed at the innermost side. In this case, also, the reinforcement film Rf is omissible together with one adjacent adhesive layer Ad, depending on the application purpose of the sealed case 10.

In the projections 14*b* and 16*b* of the cover members of this modification, the inside sealant Se is fixed by heat sealing to the heat seal strength control film Hsc of the inner circumference of the end of the trunk member 12.

Further, the sealing tape 20 of this modification is formed by laminating sealant Se, adhesive layer Ad, seal film Sf, adhesive layer Ad, reinforcement film Re, adhesive layer Ad and sealant Se in this order, from the end-face and outside of the inside end portion 12*a*-2 of the trunk material 12 and the outside opposite to the adjacent part of said end-face in the inside, to the said end-face and the inside facing said adjacent part.

In this case, also, the reinforcement film Rf is omissible together with one adjacent adhesive layer Ad, depending on the application purpose of the sealed case 10.

Namely, in the sealing tape 20 of this embodiment, the inside sealant Se is fixed by heat sealing to the end-face of the inside end portion 12*a*-2 of the trunk member 12, the adjacent part of said end-face in the outside sealant Se and the adjacent part of said end-face in the inside heat seal strength control film Hsc.

Further, in the sealing tape 20, the part adjacent to the outside end portion-face fixes the outside sealant Se by heat sealing to the inside heat seal strength control film Hsc of the outside end portion 12*a*-1 in the overlapped part of the end portions of the trunk member 12. Said part adjacent to the outside end portion-face of said inside of the sealing tape 20 fixes the outside sealant Se by heat sealing to the inside sealant Se of the inside of the projections 14*b*, 16*b* of the cover members 14 and 16.

As explained above, the sealed case 10 of the first embodiment of the invention is formed by as follows, for example.

Figure 2B:
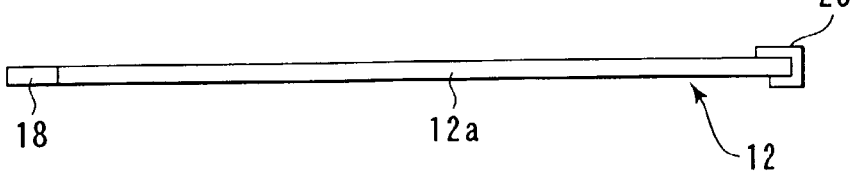
FIG. 2B is a side view of the trunk member developed in FIG. 2A.

First, as shown in FIGS. 2A and 2B, a tongue member 18 is formed in one piece at one end of material 12*a* of a trunk member 12, and a common sealing tape 20 is fastened to the end-face of the other end and the outside and inside portions adjacent to said end-face. Next, the material 12*a* of the trunk member 12 is wound around the outer circumference of a pattern rod, both end portions are overlapped, and in this overlapped part 12*b*, the inside of the outside end portion 12*a*-1 is fixed to the outside of the sealing tape 20 fastened to the inside end portion 12*a*-2, and if desired, fixed also to the outside of the inside end portion 12*a*-2. In this embodiment, in the overlapped 12*b*, the inside sealant Se of the outside end portion 12*a*-1 is heat sealed to the heat seal strength control film Hsc of the outside of the sealing tape 20 on the inside end portion 12*a*-2.

In this time, if desired, the inside sealant Se of the outside end portion 12*a*-1 can be directly fixed by heat sealing to the outside sealant Se of the inside end portion 12*a*-2.

Apart from the above, the first and second cover members 14 and 16 are molded from the above-mentioned same material and constructed to have projections or rims 14*b* and 16*b*, respectively around and outside the main parts 14*a* and 16*a*, respectively.

Before the first cover member is inserted into the opening of one end of the trunk member 12 and fixed thereto, the area around the opening of one end of the trunk member is surrounded by the concave of a split mold (not shown) from the outside of the radial direction of the trunk member 12. This concave has the same cross section and size as those of the outside of the trunk member 12, and preferably the inside of the opening of said first end portion is heated by high-temperature air.

Next, the first cover member 14 constructed as explained above is put over an insertion mold (not shown) which is expansible in the radial direction of the trunk member 12, and it is inserted into the opening of said one end of the trunk member 12 with the main part 14*a* inserted first, and the projection 14*b* around the main part 14*a* is disposed at a desired position on the inner circumference of said one end of the trunk member 12.

Next, said expansible insertion mold is expanded to push the projection 14*b* of the first cover member 14 onto the inner circumference of the first open end portion of the trunk member 12 which is surrounded and supported from the outside of the radial direction of the trunk member 12 in the concave of said split mold, and fix it thereto. In this embodiment, said insertion mold heats as well as pushing the projection 14*b* of the cover member 14, and the inside heat seal strength control film Hsc of the projection 14*b* of the first cover member 14 is heat sealed to the sealant Se of the inner circumference of the first open end portion of the trunk member 12 and the heat seal strength control film Hsc of the inside adjacent part of the sealing tape 20 of the inside end portion 12*a*-2 of the overlapped part 12*b*.

By said pushing force, the projection 14*b* including its corners of the first cover member 14 comes in close contact with all around the inner circumference of the opening of said one open end portion of the trunk member 12, and it is continuously fixed to said circumference, by heat sealing in this embodiment. This fixing can be made continuously all around or intermittently a part of said circumference.

The fixing strength control film Hsc of the rim 14*b* of the first cover member 14 controls said heat seal strength to a desired level.

It is also possible to use an adhesive instead of heat sealing to make the fixing continuously all around said inner circumference or intermittently a part thereof.

In this way, a desired article is inserted into a case whose one open end portion is closed by the cover member 14, through the other open end portion. Thereafter, the opening of the second end portion of the trunk main part is closed by the second cover member 16, in the same way as the first cover member 14.

In the above-mentioned embodiment and modification, the material and the sealing tape 20 common to the material 12*a* of the trunk member 12 and the first and second cover members 14 and 16 have the hermetic and air tight function in the inorganic material evaporated film or aluminum film constituting the seal film Sf. However, according to the philosophy of the present invention, said sealing process includes hermetic/air tight processing and moisture-proof/air tight processing. Therefore, as a seal film having the sealing function, it is possible to use an airtight film other than the above-mentioned aluminum film and inorganic material evaporated film, or a moisture-proof film made of various materials.

Further, in the above-mentioned embodiment and modification, it is possible to give desired light-shielding property to the laminar material of the trunk member 12 and cover members 14, 16. In detail, it is possible to mix a substance having desired light-shielding property with the paper base material of said material and various laminated function films, or to add a light shielding film as a function film. In this case, a light shielding film can be an image forming film for drawing desired color images on the outside of the sealed case 10. For example, the light shielding effect can be increased by using used paper instead of virgin pulp.

According to the experiments made by the inventors of this application, the light shielding effect is 5–6 abs when virgin pulp is used as a paper base material, 3–4 abs when used paper is used, and 4 abs when virgin pulp is printed black.

A sealed case according to the above-mentioned embodiment can be easily manufactured. It can be manufactured by using a paper base material made of used paper that is less strong than that made of virgin pulp.

As explained above, the fixing of the outside end portion 12*a*-1 and inside end portion 12*a*-2 of the trunk member 12 can be made indirectly by gluing the outside of the sealing tape 20 sealing the end of the inside end portion 12*a*-2 to a part of the outside end portion, as shown in FIG. 5A. In this case, it is needless to say that in the fixing area or the gluing area, it is preferable that the part corresponding to the tongue member 18 is more close to the tongue member 18 than the other parts, as indicated by a reference numeral 12'*c*. In FIG. 5A, in the fixing area 12'*c*, only the part corresponding to the tongue member 18 projects toward the tip of the tongue member 18, but the other parts are generally parallel to the end-face of the inside end portion 12*a*-2.

The fixing of the outside end portion 12*a*-1 and inside end portion 12*a*-2 of the trunk member 12 can also be made by combination of direct and indirect fixings, as indicated by a reference numeral 12"*c* in FIG. 5B; direct fixing to the outside of the inside end portion 12*a*-2 and indirect fixing to the inside end portion 12*a*-2 by the sealing tape 20 sealing the end-face of the inside end portion 12*a*-2 and the outside/ inside portions adjacent to said end-face through the portion adjacent to the outside. In this case, also, it is preferable that in the fixing area 12'c, the part corresponding to the tongue member 18 is closer to the tongue member 18 than the other parts. Here, the fixing area 12'c is gradually bending from the part corresponding to the tongue member 18 toward the end-face of the inside end portion 12a-2 as it advances to both sides of the inside end portion 12a-2.

Description will now be given on a second embodiment of the present invention hereinafter with reference to FIG. 6A to FIG. 10C. In these figures, the same reference numerals are given to the substantially same members, and detailed explanation will be omitted.

In the second embodiment, a photograph film cartridge is used as an article to be housed in a case. It is needless to say that this embodiment can be easily applied to other articles.

Figure 6A:
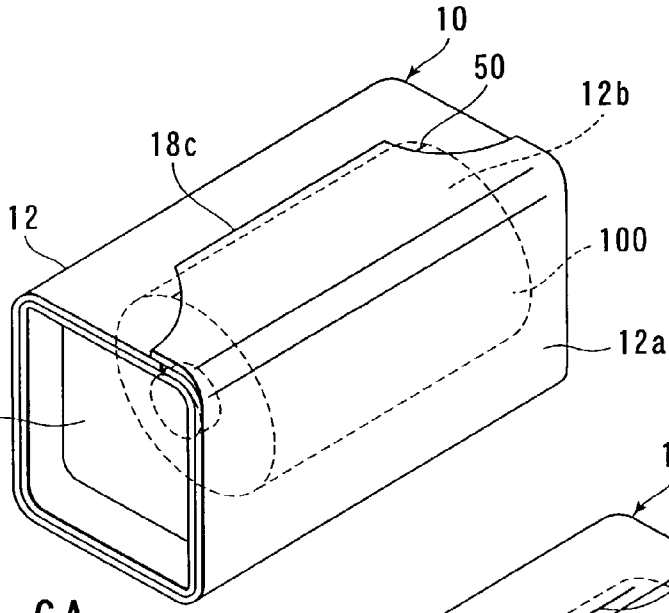
Figure 6B:
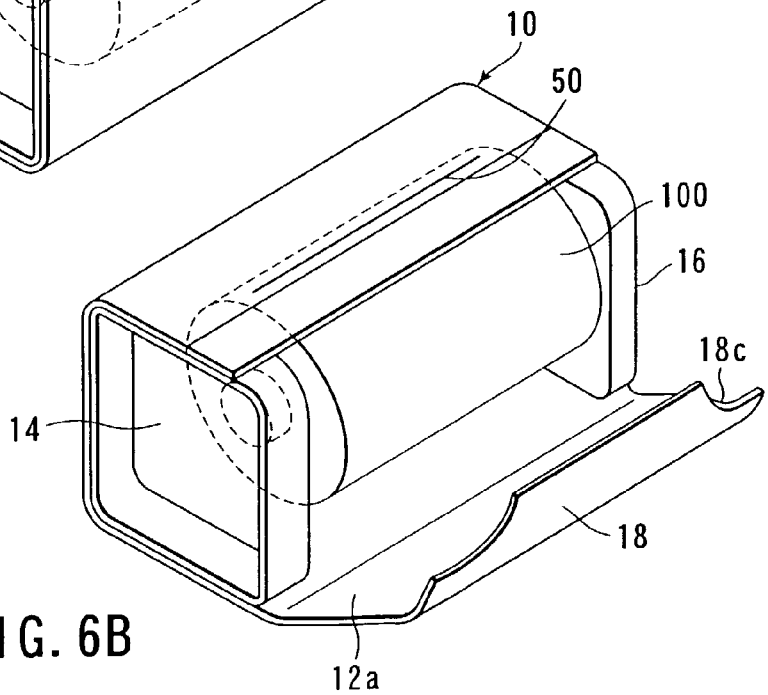

A photograph film case 10 has a rectangular trunk with a square cross section and round corners. To realize the re-close ability, the case has a tongue member 18 in its material or a blank 12a, and the tip 18c of the tongue member 18 can be inserted into a cut or a slit 50 provided in a cylindrical trunk member or a trunk 12, after the case is unsealed. As shown in FIGS. 6A and 6B, the photograph film case 10 comprises the cylindrical trunk member 12 made of material 12a, a first cover member 14 and a second cover member 16 to seal the openings at both end portions of the cylindrical member 12. A 135-type film cartridge 100 is contained in the case as one embodiment.

The sheet material 12a is longer than the outer circumference of the trunk member 12, making an overlapped part 12b by overlaying and gluing to the outside of the trunk member 12 in the width direction from the first cover member 14 to the second cover member 16. The tip of the material 12a, or the tip of the outside end portion forms a tongue-like member 18. While the case is sealed, the overlapped part of the sheet 12a is glued by appropriate strength, and the case 10 can be held moisture-proof. Namely, the gluing strength of the overlapped part is the degree not to be peeled off during transportation, displaying or user's handling. However, when the tongue-like or pick-up member 18 is pulled by the force of averaged persons when using the product such as a photograph film contained in the case, the gluing of the overlapped part is released and the case can be unsealed.

In a part of the sheet 12a covered by the member 18, a slit 50 is provided for insertion of the tip 18c of the tongue-like member. By inserting the tip 18c of the released edge member 18 into the case through the slit 50, the shape of the cylindrical trunk member 12 can be reproduced, that is, the case can be re-closed.

The width of the slit 50 is selectable, but the tip 18c of the edge member is preferably 35–70% of the width of the material, especially 50–60% is preferable.

Figure 7A:
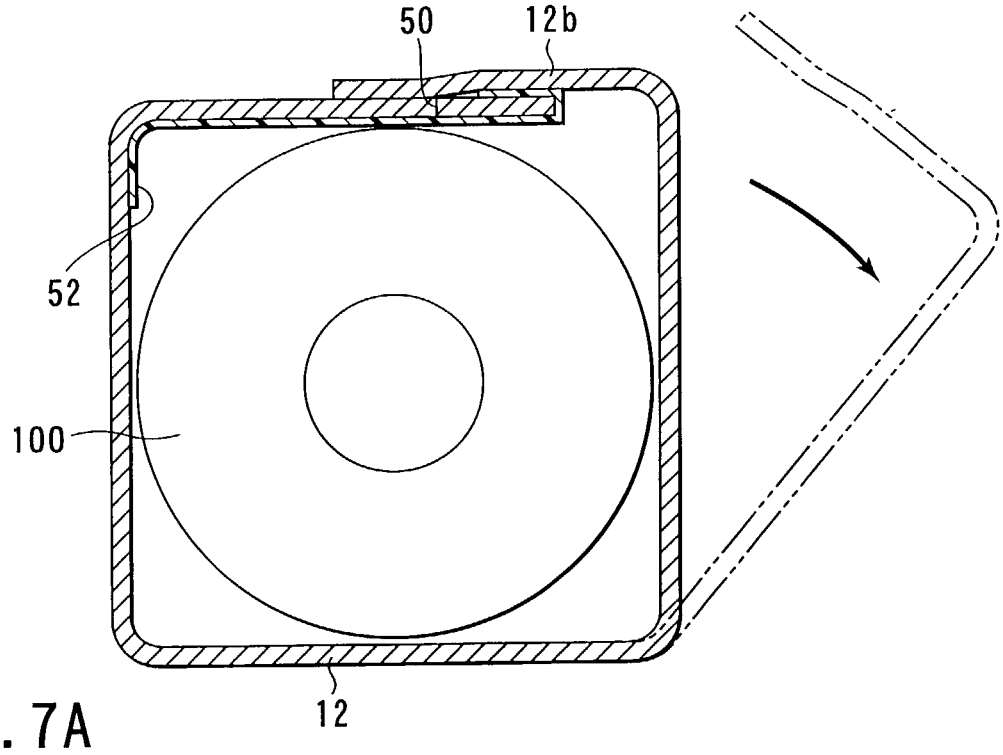
FIG. 7A and FIG. 7B are respectively sectional view and partially broken view of the sealed case of the second embodiment.

As shown in FIG. 7A, a moisture-proof film 52 is provided in the trunk member 12 so as to cover the slit 50. The moisture-proof film 52 is provided in the width from the first cover member or a seal cover 14 up to the second cover member or a seal cover 16, covering the area around the slit 50 from the inside of the trunk member 12, and preventing ingress of gas or moisture from the slit 50. The moisture-proof film 52 wraps the inner end of the material 12a, reaching up to the overlapped part 12b provided outside of the trunk member 12. Protection of the internal end of the trunk member 12 by the moisture-proof film, so-called "edge-protect" is important, preventing ingress of gas or moisture into the case through the cut end-face of the material 12a, and ensuring the moisture resistivity of the case 10. The moisture-proof film 52 is fixed by heat sealing or the like to the inside surface of the trunk member 12 appropriately distant from the slit 50, just like surround the slit, so that the inside of the slit 50 is made like a bag to permit insertion of the tip 18c of the edge member.

Figure 7B:
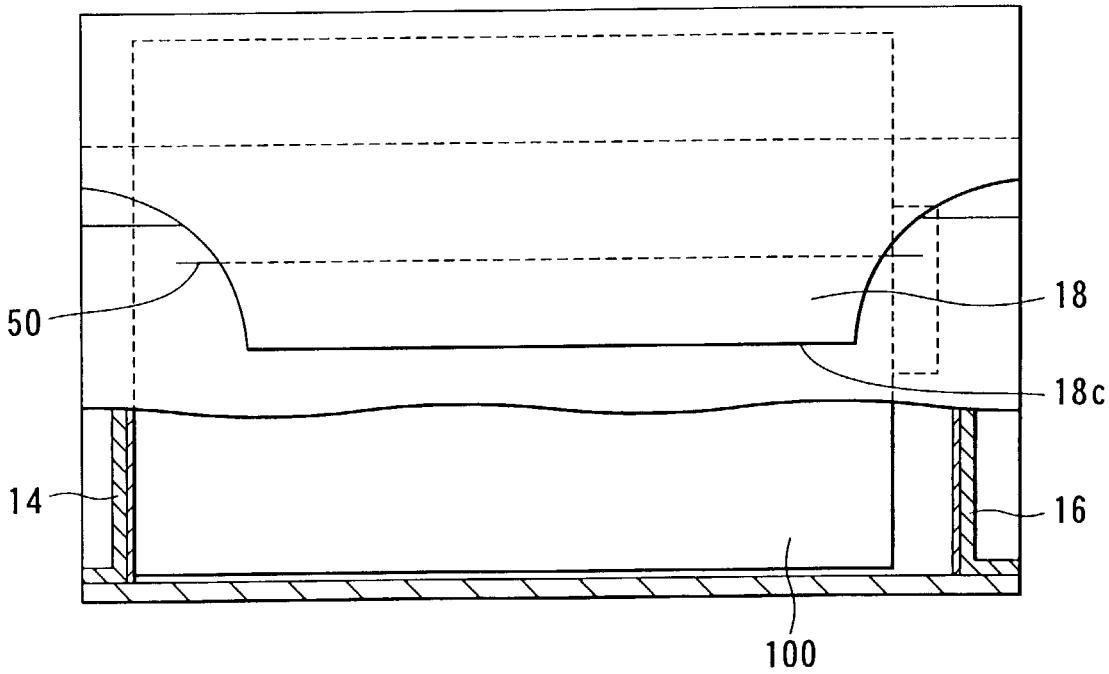

As shown in FIG. 7B, a photograph film cartridge 100 contained in the case can be fixed in being held by the first cover member 14 and the second cover member 16. When the second cover member 16 is closed with the four sides of the trunk member 12 being pressed inward compared to the natural state, after a sealed case 10 is completed, the cover members 14 and 16 are pushed inward by the returning force of the cylindrical trunk member 12, and the photograph film cartridge 100 is fixed within the case 10 by the cover members 14 and 16 of this state.

A case 10 according to the second embodiment is manufactured by molding a trunk member 12 and fitting a first cover member 14, then loading an article 100 such as a 135 type film cartridge in the cylindrical trunk, and finally fitting a second cover member 16. During fitting the second cover member 16, as stated above, the article 100 can be fixed to the inside of the trunk member 12 in being held by the elastic force of the first and second cover members 14 and 16.

Figure 8A:
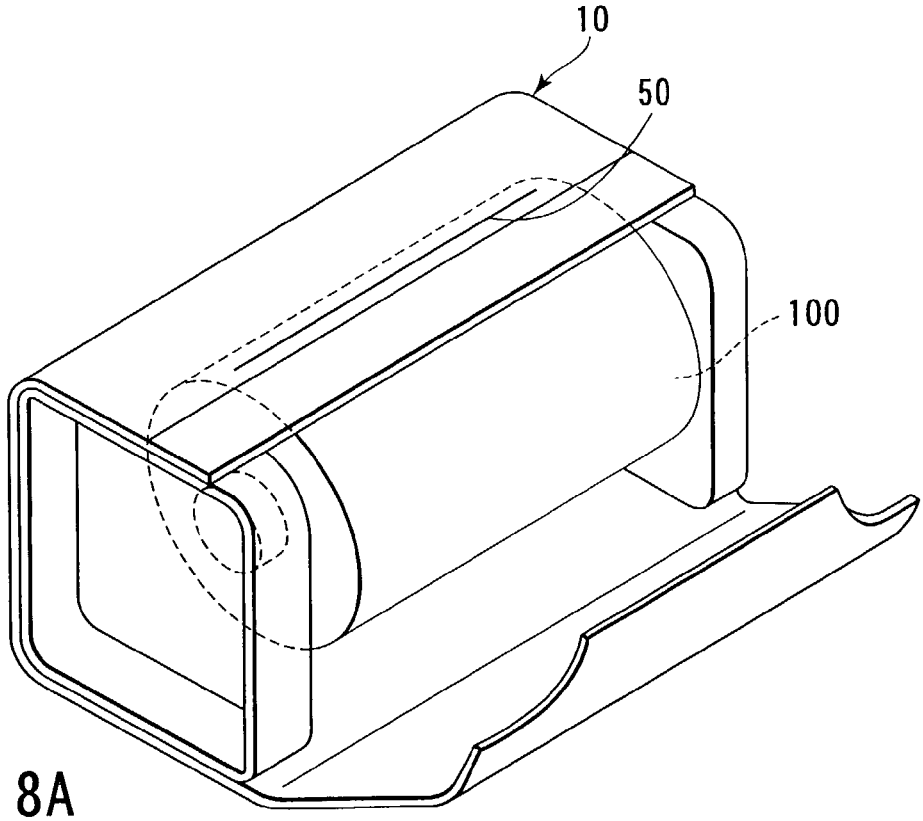
FIG. 8A and FIG. 8B are respectively perspective views of the sealed case of the second embodiment, being unsealed and being resealed.

The case 10 can be unsealed by pinching the tab 18 provided integral with the outside end portion of the sheet and pulling it up, as shown in FIG. 8A. Namely, the gluing between both parts of the sheet material 12a can be released by the pulling action, and then the gluing between the trunk part and the first and second cover members 14, 16 can be peeled off to the state where one side of the rectangular trunk 12 is completely released. By this unsealing action, the product or the article, the 135-type photograph film cartridge 100 in this embodiment can be easily taken out.

Figure 8B:
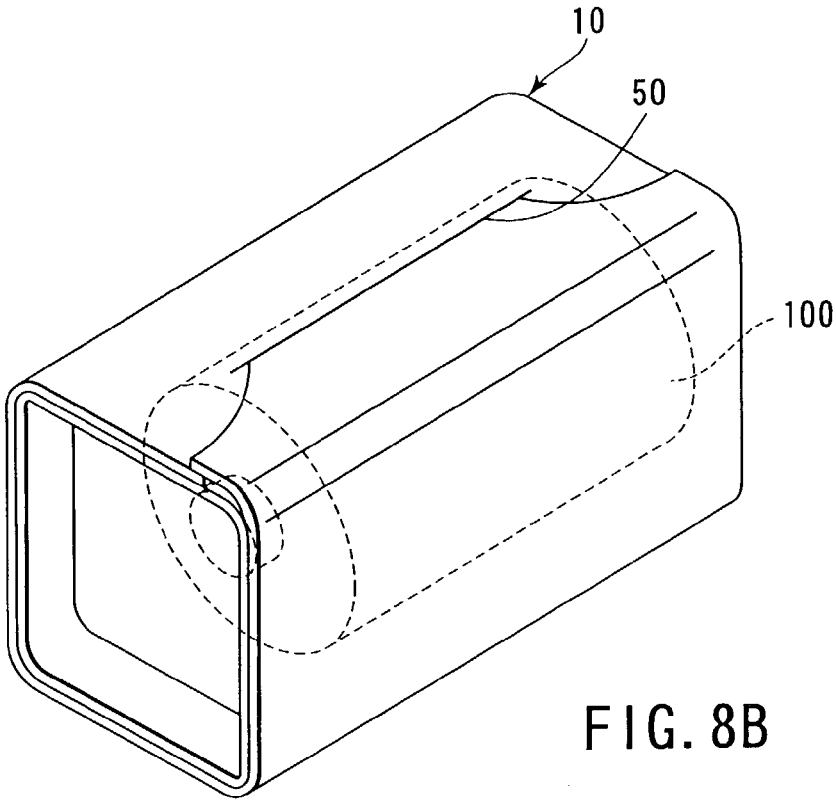
Figure 9A:
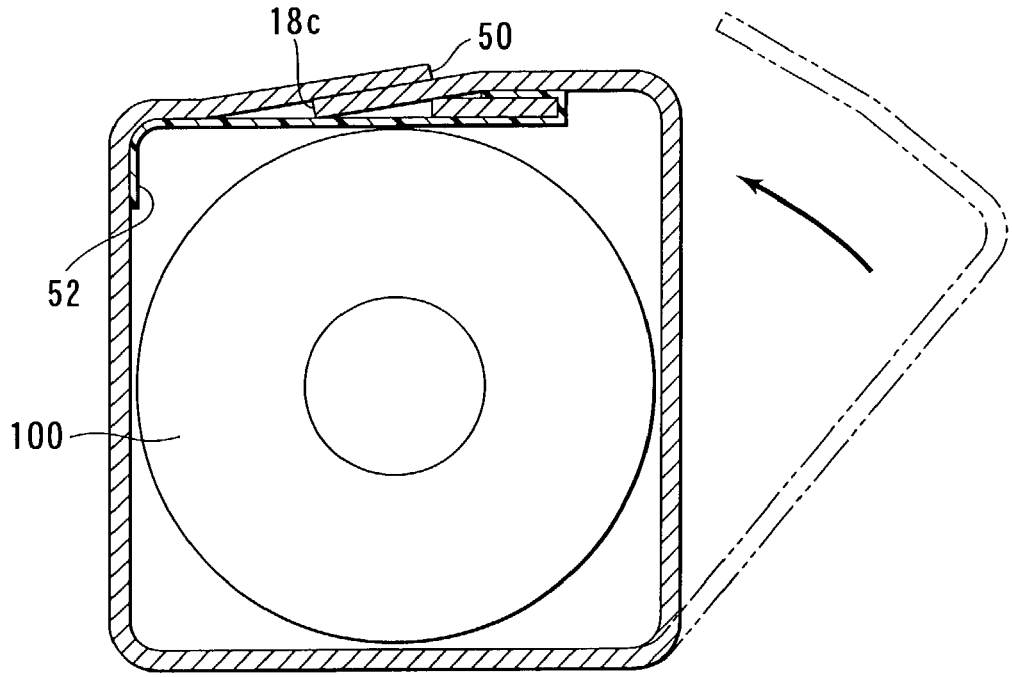
FIG. 9A and FIG. 9B are respectively sectional view and partially broke view showing a state of resealing the sealed case of the second embodiment.
Figure 9B:
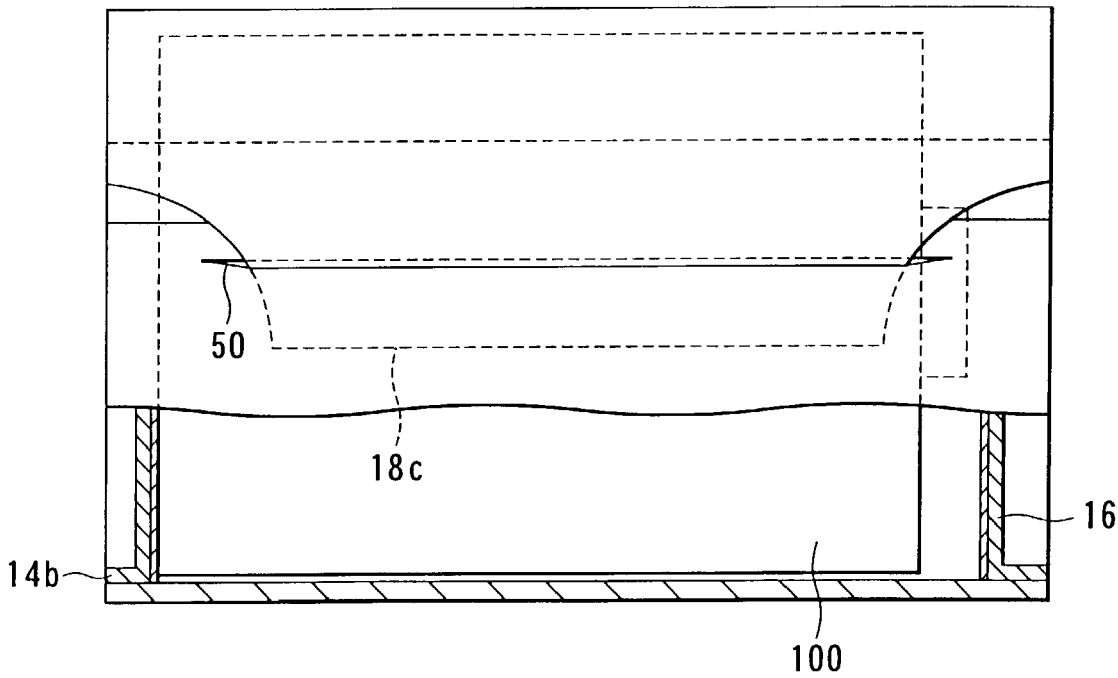

After the photographing, re-load the photograph film cartridge 100 into the unsealed photograph film case, and as indicated by an arrow in FIG. 9A, turn the edge member in the trunk member direction, and insert the tip 18c of the tab 18 into the slit 50, whereby the trunk member can be restored to its original form as shown in FIGS. 8B and 9B. Since the tip of the tab 18 inserted into the case through the slit 50 is fixed in being held by the sheet 12a and the moisture-proof film 52, the trunk will be held in this state.

Next, an example of a method of manufacturing the case 10 with the above-mentioned structure will be explained.

It is preferable to use a laminate with a metal film or an inorganic oxide evaporated layer as a sheet or blank material 12a used for manufacturing the case of the present invention. Cut a slit 50 in the blank 12a, and stick a moisture-proof film 52 on the blank, before making the case. The slit 50 may be a simple cut, or an opening with a certain width. Heat seal the moisture-proof film 52 to the sheet 12a up to its outside, so that the slit 50 can be covered from the inside and the cut end of the sheet 12a can be covered. In this case, it is sufficient to stick only both sides of the moisture-proof film 52 to the inside of the sheet 12a in parallel to the elongate direction of the slit from the first cover member 14 to the second cover member 16. By sealing the first and second cover members 14 and 16, the slit is sealed vertically to said elongate direction.

Make the cylindrical trunk member 12 by using the blank 12a. The moisture-proof film 52 has been heat sealed to the outside of the sheet 12a, covering the cut end of the sheet 12a parallel to the slit 50. Glue weakly the moisture-proof film 52 and the inside of the sheet 12a. For this purpose, it is preferable to provide a sealant layer as one of the inside outermost layer of the laminate sheet 12a or the outermost layer of the moisture-proof film 52.

The cross section of the trunk member 12 is optional, but preferably polygonal with round corners. Particularly, square, pentagon or hexagon is preferable. A square with round corners is most preferable.

Next, fit the first cover member 14 to the first end portion of the trunk member 12 to close an opening portion. Although there are various methods of sealing, it is preferable to fit the cover member 14 shaped to fit the inside of the trunk member 12 onto one end of the trunk member, and heat seal the outer circumference of the rim projection 14*b* of the cover member and the inner circumference of the end of the cylindrical trunk member 12. After loading the article 100 into the trunk member 12, close the second end portion of the trunk member 12 by the second cover member 16 in the similar manner, thereby completing the sealed case 10.

Figure 10A:
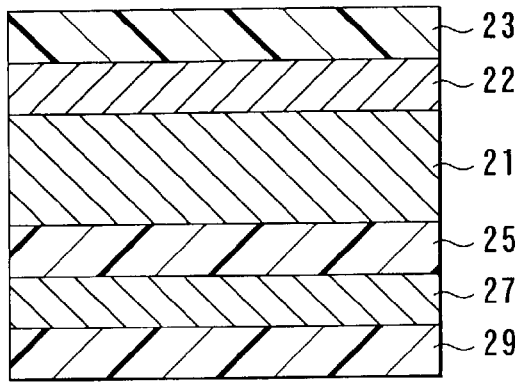
Figure 10B:
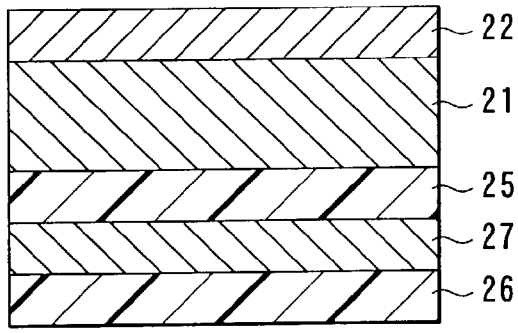
Figure 10C:
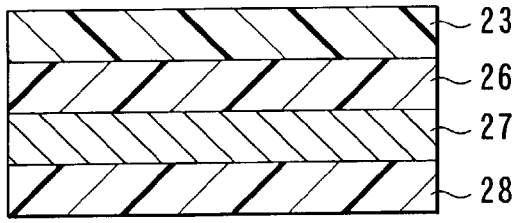

FIGS. 10A to 10C are the sectional views showing lamination examples of substance usable as a re-containable case according to the present invention. FIG. 10A shows the lamination of the material. FIG. 10B shows the lamination of the cover member. FIG. 10C shows the lamination of the moisture-proof film.

First, the material will be explained with reference to FIG. 10A.

The sheet material is a gas-barrier lamination including a paper layer or a paper base material 21. There is a print layer 22 with design printed thereon on (outside) the paper layer 21. A thermoplastic resin layer 23 of polyolefin group such as polyethylene (PE) may be provided outermost as a heat seal layer. Laminated downwardly from the paper layer 21 are a thermoplastic resin layer 25 of polyolefin group such as a PE layer, a gas-barrier evaporated layer 27 and a sealant or heat seal layer 29.

As a gas-barrier evaporated layer or a hermetic film 27, a metal or inorganic oxide evaporated layer can be used, as long as resistant to gas such as oxygen and vapor. As a metal to be evaporated, there are aluminum and magnesium, for example. As inorganic oxide to be evaporated, there are silicon oxide, magnesium oxide, aluminum oxide, for example. The gas-barrier evaporated layer 27 of the embodiment is not to be limited by the metal or inorganic oxide evaporated layer. Any material having the above-mentioned bas-barrier function can be used.

For these inorganic oxide evaporated films, refer to the Thin Film Handbook, page 879–901 (the Japan Society for the Promotion of Science), the Vacuum Engineering Handbook, page 502–509, page 612, page 810 (Nikkan Kogyo Shinbun—The Japan Daily Industrial Newspapers), and the Vacuum Handbook—Revised edition, page 132–134 (ULVAC Japan Vacuum Engineering K.K.).

As a specific example, there are $Cr_2O_3$, $Si_xO_y$ (x=1, y=1.5–2.0), $Ta_2O_3$, ZrN, SiC, TiC, PSG, $Si_3N_4$, single crystal Si, amorphous Si, W, $AlI_2O_3$.

The thickness of said gas-barrier evaporated layer 27 depends on the type and configuration of the metal or inorganic oxide to be used, and generally, 15–300 nm is preferable. A specific value is selectable. However, if the film thickness is less than 30 nm, a film may be formed not all the surface of the base material 21 or the formed film thickness may be insufficient, and the film may not function as a gas-barrier layer. Contrarily, if the film thickness is over 300 nm, it becomes difficult to give flexibility to the film, and a crack may occur in the film due to bending, tensile force or other external factors. The preferable evaporated film thickness is 20–150 nm.

There are various methods of forming the evaporated layer 27 consisting of metal or inorganic oxide on the sealant layer or heat seal layer 29, but an ordinary vacuum evaporation is representative. The other thin film forming methods, such as a spattering method and an ion plating method can also be used. At present, the vacuum evaporation method has the highest productivity. In the vacuum evaporation system used for vacuum evaporation, an electron beam heating method or a resistance heating method is preferable as a heating means. It is possible to use a plasma assisted method or an ion beam assisted method in order to enhance the adhesion between an evaporated film and a base material or the density of a formed thin film.

The sealant 29 is formed by a material which can be easily peeled off and unsealed. Namely, while the case is unsealed, the sealant 29 is heat sealed to the moisture-proof film and seals up the overlapped part 12*b*. However, when the case is unsealed, since the gluing force of the overlapped part 12*b* is appropriately weak, the fixing of the overlapped part 12*b* can be released.

The sealant 29 can be manufactured by using a thermoplastic film such as PE. If necessary, it is permitted to provide an anchor coat layer as described in Jpn. Pat. Appl. KOKAI Publication No. 2000-6304, or a primer layer consisting of a resin having the shearing elastic modulus of $(0.01-1)\times10^9(N/m^2)$ as described in Jpn. Pat. Appl. KOKAI Publication No. 2001-145973.

The polyolefin group thermoplastic resin layer 25 functions as an adhesive layer when sticking the gas-barrier evaporated layer 27 and paper layer 21 by melting said resin like a curtain upon extruded laminate. Considering the workability at a low temperature by reducing the shrinkage at lamination, MFR is preferably at least 3 (g/10 min). If MFR is lower than 3 (g/10 min), the low-temperature workability is inferior, and as shrinkage at lamination increases, a crack may occur in the evaporated film affecting the gas-barrier property. It is preferable that MFR is in a range of 5–14 (g/10 min).

As a polyolefin group thermoplastic resin layer 25, polyethylene, polypropylene, ethylene-acetic acid vinyl copolymer or ionomer can be used. Judging from the aptitude to the extrusion work, polyethylene is most preferable.

When melting and extruding said polyolefin group thermoplastic resin like a curtain or a thin film, the temperature is preferably as low as not deteriorating the gas-barrier property of the gas-barrier evaporated layer 27. The optimum condition is different depending on the type of resin to be used and the extrusion thickness. The temperature is preferably 320° C. or lower for polyethylene, more particularly, 300° C. or lower. If the temperature exceeds 320° C., the evaporated film will be damaged by the heat and the gas-barrier property may be deteriorated. If the temperature is 250° C. or lower, an extrusion defect may occur. The preferable melting/extruding temperature is 250–320° C.

When the extrusion temperature becomes 260° C. or lower, natural oxidation upon free drop from T-die becomes insufficient, and the adhesion between the sealant base material and paper may become weak. Thus, forced oxidation is preferable to compensate for this insufficient oxidation. As an extrusion laminate in such a case, it is preferable to use also surface treatment such as ozone processing or corona processing, at the same time.

As ozone processing, spray at least one side of the molten resin an appropriate amount of ozone neither lowering excessively the resin temperature nor vibrating. A known method of generating ozone is no problem. For example, ozone can be easily generated by air discharging within an airtight vessel, and ozone can be quantitatively transported by a carrier gas.

The thickness of the polyolefin group thermoplastic resin 25 depends on the resin composition, extrusion temperature and other conditions. For example, when extrusion molding polyethylene at a temperature lower than 300° C., the thickness of 10–20 μm is preferable. If the thickness exceeds 20 μm, a stress increases when the resin is cooled and hardened, and the distortion is transmitted to the evaporated film, causing cracks. When the thickness is less than 10 μm, there may be a problem in extrusion. The preferable resin thickness is 15–20 μm.

The paper layer 21 has a function of giving strength to a case. It is used also as a print base material to print letters, pictures or drawings. The kind of paper is selectable depending on the function and printing contents of an object packing material. For example, fine quality paper, kraft paper or coated paper can be used. The paper thickness is also selectable depending on the purpose of application.

The heat seal layer 23, which may be provided as an outermost layer, is used as an adhesive film when making the overlapped part 12*b* of the trunk member 12. As a heat seal layer 23, resins such as polyethylene, polypropylene, ethylene-acetic acid vinyl copolymer, ethylene-methacrylic acid copolymer, ethylene-methacrylic acid ester copolymer, ethylene-acryl acid copolymer, ethylene-acryl acid ester copolymer and their metal bridges can be used. The thickness of the layer 23 is determined depending on the purpose, and generally 15–200 μm. As a heat seal layer laminating method, there are several known methods such as a dry lamination by piling the films of said resigns, an insolvent lamination, extrusion lamination by melting said resigns and an extruding like a curtain, for example.

Next, the materials of the cover members 14 and 16 will be explained by referring to FIG. 10B.

The cover member is also a gas-barrier laminate containing a paper layer 21. A print layer 22 is provided on the outside of the paper layer 21. On the inside of the paper layer 21, a polyolefin group thermoplastic resin layer 25 is laminated on the gas-barrier evaporated layer 27 which is piled on a plastic base material 26.

The plastic base material 26 is made of high-polymer plastic material and used as a base of evaporation. The base material is made of, for example, a polyester film such as a polyethylene terephtalate (PET) and polyethylene naphthalate film, a polyolefin film such as a polyethylene and polypropylene film, a polystyrene film, a polyamide film, a polyvinyl chloride film, a polycarbonate film, a polyacrylonitrile film, a polyamide film. Either drawn or non-drawn films can be used. The material having mechanical strength and dimensional stability is recommendable.

The high-polymer plastic material is processed to be films and used as a plastic base material 26. Particularly, polyethylene terephtalate drawn optionally in two axes is preferable. It is permitted to coat the plastic base material 26 by known additive or stabilizer such as antistatic agent, anti-ultraviolet rays agent, plasticizer and lubricant. To improve adhesion to an evaporated film, it is permitted as pre-processing to treat the plastic material surface by corona processing, low-temperature plasma processing or ion bombardment. In addition, chemical processing or solvent processing is allowable.

The thickness of the plastic base sheet 26 is not particularly limited. Considering the aptitude as packing material, the characteristic to laminate other layers thereon, and the workability when forming a gas-barrier evaporated layer 27, the thickness of 3–200 μm is practical, and 6–30 μm is preferable.

Further, considering the mass-productivity, it is preferable to make the plastic base sheet 26 long lengths to enable forming thin films continuously.

Concerning the gas-barrier evaporated layer 27 and polyolefin group thermoplastic resin layer 25, the explanation is the same as those for the laminates for said material.

Next, the moisture-proof film material will be explained by referring to FIG. 10C. In the moisture-proof film, a polyolefin thermoplastic layer 23 is formed as a heat seal layer on the surface of a plastic base material 26, a gas-barrier evaporated layer 27 is formed on the underside of the plastic base material 26, and a heat seal layer or a sealant layer 28 is formed underside of the layer 27.

As already explained, in the case of the embodiment, the easy-to-unseal overlapped part 12*b* is formed by a sealant layer and a heat seal layer. The heat seal layer can be provided in any of (1) the outermost layer of the material, (2) the outermost layer of the moisture-proof film 52 made by heat sealing the material and (3) the innermost layer of the material. When using the case of the present invention as a moisture-proof case for photographing light-sensitive material, it is preferable to set the moisture permeability of the material, the first and second cover members and moisture-proof film to 1.0 g/m$^2$·24 h (40° C.·90% RH) or less. This moisture permeability is measured by the method defined by JIS•Z0208.

An article to be contained in the sealed case of the present invention is not particularly limited. However, since the sealed case of the invention can be used as an excellent moisture-proof gas-barrier case, it is suitable for a package of detergent disliking vapor, photograph film, foods and medicines to be kept away from vapor or oxygen, and the like. To completely eliminate the influence of oxygen and vapor during storing, it is permitted to put a dehydrator or a deoxygenerator in the case together with the product to be packed.

Further, the case of the second embodiment of the present invention is re-containable, and it is suitable for storing a product after unsealing the case or sending back a product for post-processing. A photograph film is an example of such products. The case is suitable for containing a 135-type film cartridge, Brownie film, APS film and other roll type films.

Since the case of the embodiment is a single package made mainly of paper, it causes no problem when burning up and decreases environmental load. If the case is made to have the square cross section, it is convenient for displaying or storing.

Further, since the re-containable case is composed of gas-barrier and vapor-barrier laminates, it is resistant to oxygen and vapor. Further, the case is easy to unseal, and re-contains a product at need. The case can be disposed by incineration.

It becomes apparent from the above description that the sealed case according to the embodiment of the present invention is more hermetic than the conventional cases, but it can be manufactured at lower costs.

Moreover, the case of the invention realizes the hermeticity satisfying the airtightness and moisture-proofness to meet the gas-barrier requirement to the gas including oxygen. It is suitable for packing detergent and photograph film disliking vapor or foods and medicines to be kept away from vapor and oxygen.

Description will now be given on an example of a method of molding the cover member used in the case of the abovementioned embodiment hereinafter with reference to FIG. 11A to FIG. 14B.

The fist and second cover members are substantially the same except that its projection or rim is provided on the main part in the reverse direction. Thus, only a method of molding the first cover member will be explained.

Figure 11A:
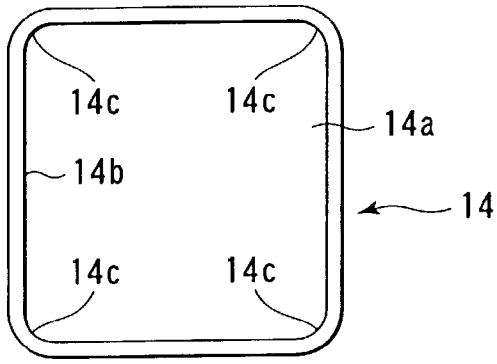
FIG. 11A and FIG. 11B are respectively plane view and side view of the cover member of the sealed case of the embodiment of the invention.
Figure 11B:
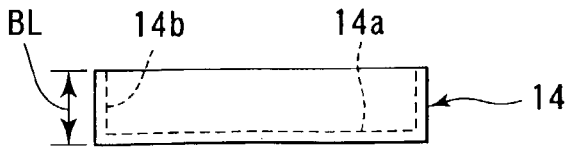

As shown in FIGS. 11A and 11B, the cover member 14 comprises a flat part of predetermined shape or a main part 14*a* and a peripheral bent portion or a rim 14*b* bent at the periphery of the flat part 14*a*. The predetermined shape of the flat part 14*a* is a kind of polygon, or square with staged portions. This square cover member has staged corners 14*c*. Each corner 14*c* is formed by a small-radius curved surface to prevent breakage by the stress concentrated when the cover member 14 is formed. (In the first embodiment, the corners of the cover member are shown as right-angles, but preferably they are formed by curved surfaces as in the second embodiment cover member.)

Figure 12A:
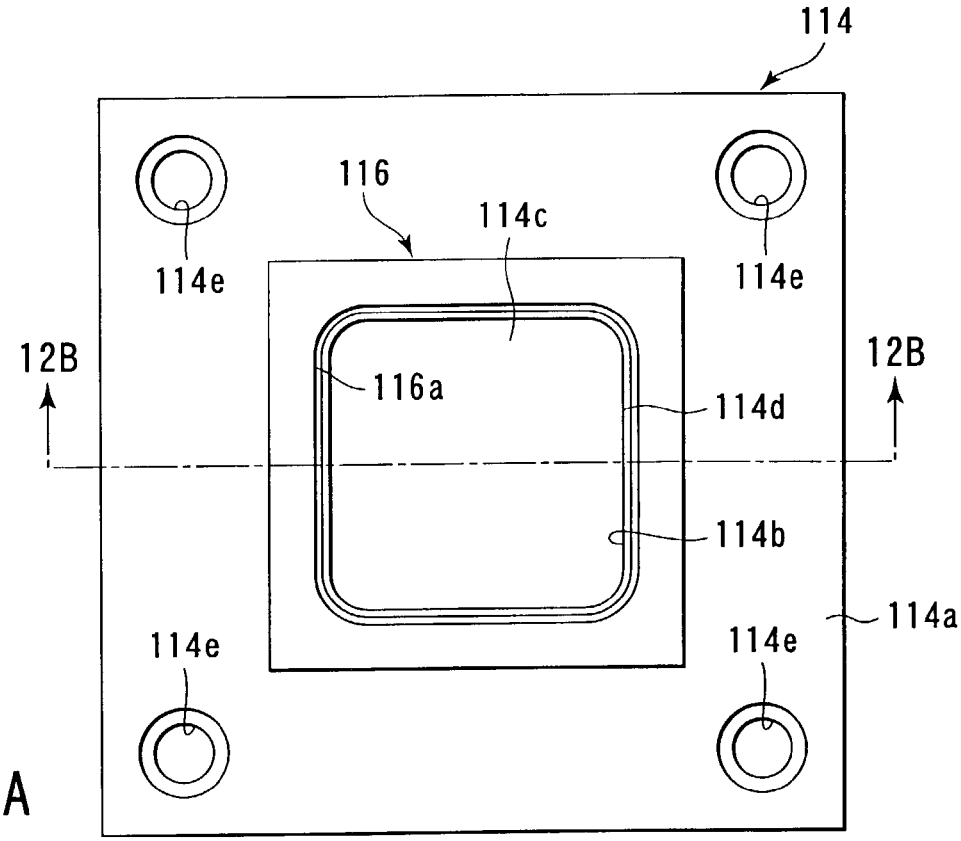
FIG. 12A is a schematic plane view of a female mold and a sheet material holder which are members of a cover member molding machine usable for molding the cover member of the unsealed case of the embodiment of the invention.
Figure 12B:
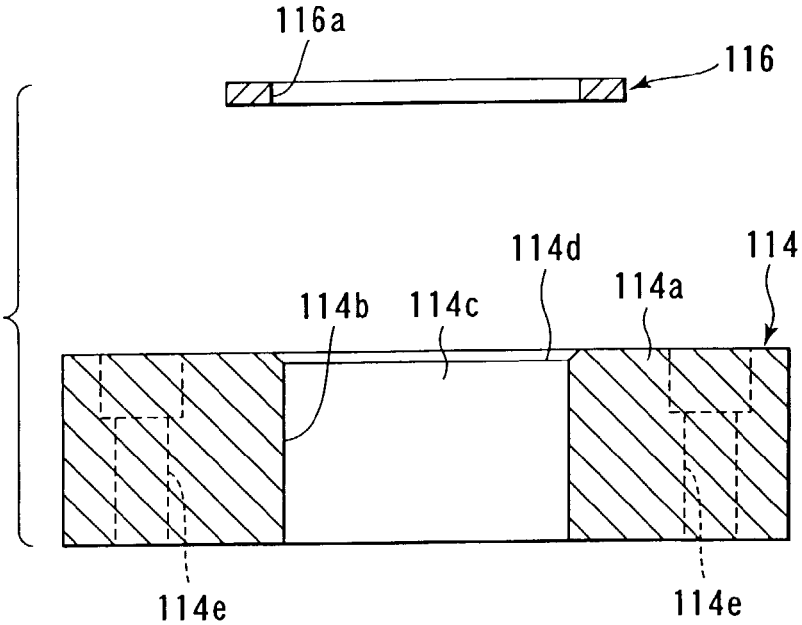
FIG. 12B is a schematic sectional view taken along the line 12B—12B of the female mold and sheet material holder of FIG. 12A.

First, description will be given on a female mold 114 and a sheet material holder 116 to be used together with the female mold which are members of a cover member molding machine with reference to FIGS. 12A and 12B. FIG. 12A is a schematic plane view of a female mold 114 and a sheet material holder 116. FIG. 12B is a schematic sectional view taken along the line 12B—12B of the female mold 114 and sheet material holder 116 of FIG. 12A.

The female mold 114 has a flat surface 114*a* to place a sheet material (not shown) for the cover member 14. On the material placing surface 114*a*, an opening 114*c* is provided having an inner circumference 114*b* corresponding to the predetermined form of the flat part 14*a* of the cover member 14. Specifically, the shape and size of the inner circumference 114*b* are substantially the same as those of the side of the flat part 14*a* of the cover member 14 shown in FIGS. 11A and 11B where the peripheral bent portion 14*b* is not bent (i.e., the inside surface). An entrance edge 114*d* of the opening 114*c* of the material placing surface 114*a* is chamfered. The chamfered shape of the entrance edge 114*d* is a convex curve.

The female mold 114 is fixed, by fixing screws (not shown) inserted into fixing screw insertion holes 114*e*, at a predetermined position (not shown) of a workshop (not shown) where the cover member molding machine is installed.

The sheet material holder 116 has an opening which has a circumferential edge 116*a* larger than the entrance edge 114*d* of the opening 114*c* of the material placing surface 114*a* of the female mold 114.

The sheet material holder 116 is movable between the predetermined release position isolated from the flat plate 114*a* of the female mold 114 as shown in FIG. 12B, and the position where a sheet material (not shown) for the cover member 14 of FIGS. 11A, 11B is placed on the material placing surface 114*a* of the female mold 114, the opening of the sheet material holder is fit to the entrance edge 114*d* of the opening 114*c* of the material placing surface 114*a* of the female mold 114, the sheet material holder is pressed to the sheet material placed on the material placing surface 114*a* of the female mold 114, and the sheet material is pressed onto the material placing surface 114*a*.

Figure 13A:
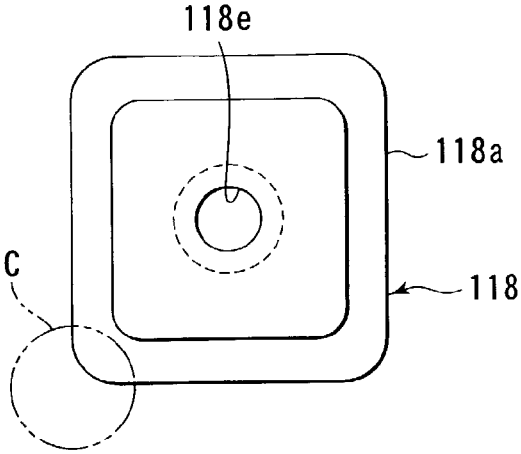
FIG. 13A is a schematic plane view of a male mold which is another member of a cover member molding machine.
Figure 13B:
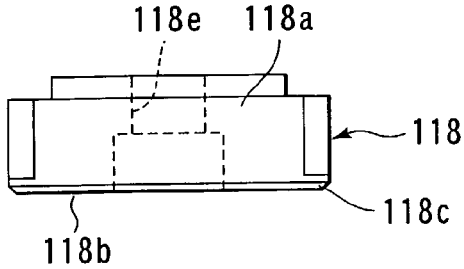
FIG. 13B is a schematic side view of the male mold of FIG. 13A.
Figure 13C:
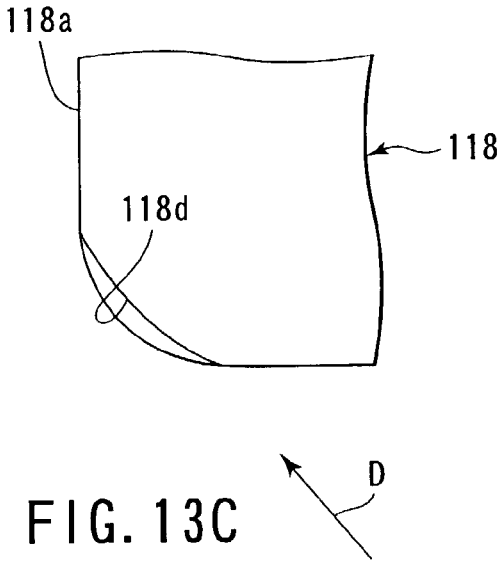
FIG. 13C is a schematic magnified plane view of the part encircled by the alternate long and two short dashes line indicated by a reference character C in the male mold of FIG. 13A.
Figure 13D:
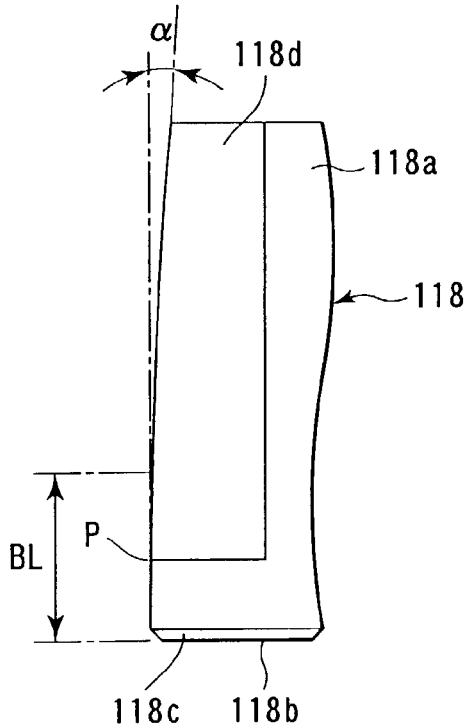
FIG. 13D is a schematic magnified side view of the magnified part of FIG. 13C viewed from the arrow D direction.

Next, description will be given on the structure of a male mold 118 which is another member of said cover member molding machine and is used in combination with the female mold 114 and the sheet material holder 116, with reference to FIGS. 13A to 13D. FIG. 13A is a schematic plane view of a male mold 118 which is another member of the cover member molding machine. FIG. 13B is a schematic side view of the male mold 118 of FIG. 13A. FIG. 13C is a schematic magnified plane view of the part encircled by the alternate long and two short dashes line indicated by a reference character C in the male mold 118 of FIG. 13A. FIG. 13D is a schematic magnified side view of the magnified part of FIG. 13C viewed from the arrow D direction.

The male mold 118 has an outer circumference 118*a* of predetermined shape corresponding to said predetermined shape of the flat part 14*a* of the cover member 14, and a contact surface 118*b* which makes contact with the sheet material (not shown) being placed on the flat part of the female mold 114 shown in FIG. 12A and being pressed by the sheet material holder 116 onto the material placing surface 114*a*. More specifically, the predetermined shape and size of the outer circumference 118*a* are substantially the same as those of the side of the flat part 14*a* of the cover member 14 shown in FIGS. 11A, 11B where the peripheral bent portion or rim 14*b* is bent (i.e., the outside surface).

A boundary edge 118*c* between the outer circumference 118*a* and the contact surface 118*b* is chamfered. The chamfered shape of the boundary edge 118*c* is a convex curve.

At least staged portion (corner) 118*d* of the outer circumference 118*a* is inclined inward along the contact surface 118*b* by an angle of $\alpha$, as it goes away from the contact surface 118*b* further from the position P which is separated from the contact surface 118*b* by the distance shorter than BL, the bent length of the peripheral bent portion 14*b*. At least staged portion (corner) 118*d* of the outer circumference 118*a* is, in the part from the contact surface 118*b* to the position P, formed by a substantially straight line orthogonal to the contact surface 118*b*.

At the center of the surface of the male mold 118, a connection hole 118*e* is formed. Connected to the connection hole 118*e* is the end portion (shown by a reference 122 in FIGS. 14A and 14B) of a reciprocating member of a known reciprocating unit which supports the male mold 118 corresponding to the opening 115*c* of the material placing surface 114*a* of the female mold 114 fixed to a predetermined position (not shown) in said workshop (not shown). The unit reciprocates the male mold between the isolated position where the male mold 118 is located upward the opening 114*c* of the material placing surface 114*a* of the female mold 114 and the position where the male mold 118 is inserted a predetermined depth into the opening 114*c*.

Description will now be given on a process of molding the cover member 14 shown in FIGS. 11A and 11B, from the sheet material by the cover member molding machine which is constructed by a combination of said female mold 114, sheet material holder 116 and male mold 118, with reference to FIGS. 14A and 14B.

Figure 14A:
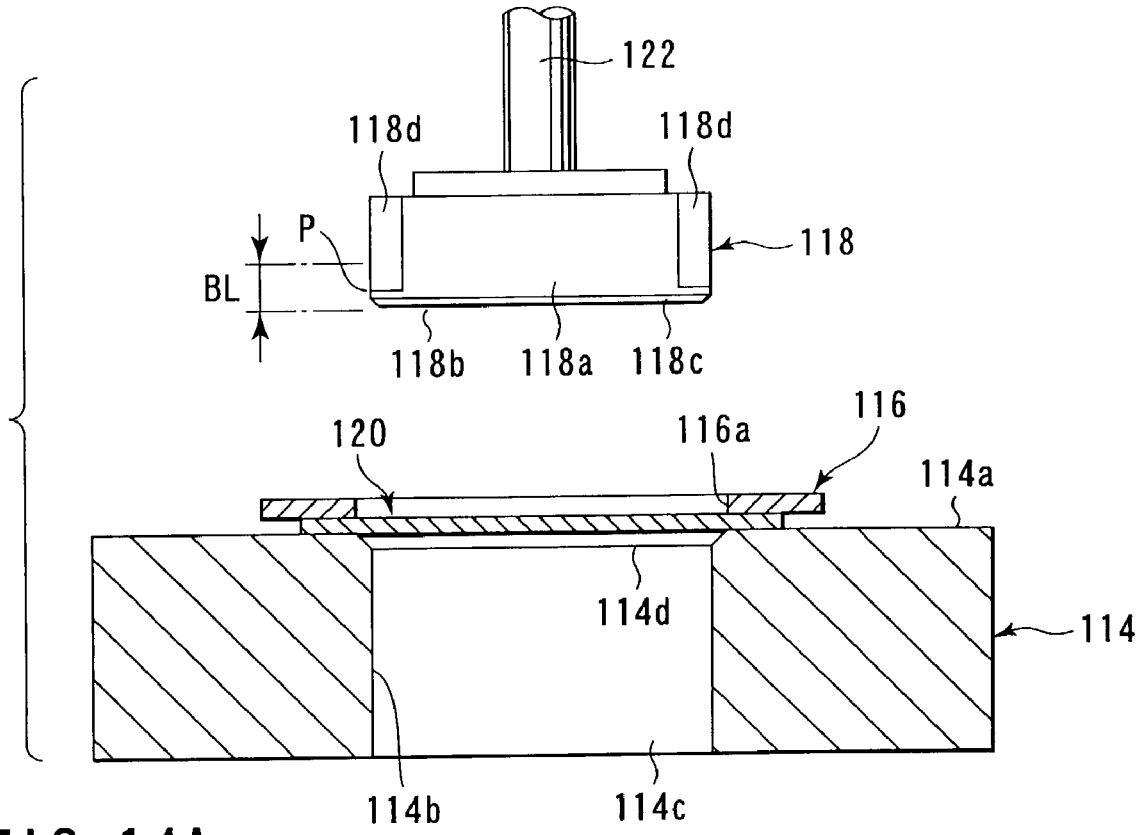
FIG. 14A is a schematic longitudinal sectional view showing the process immediately before a cover member molding machine makes the cover member from the sheet material.

Here, FIG. 14A a schematic longitudinal sectional view showing the process immediately before molding a cover member 14 from the sheet material using the cover member molding machine. FIG. 14B is a schematic longitudinal sectional view showing the process immediately after molding the cover member 14 from the sheet material using the cover member molding machine.

A sheet material 120 which is molded by the cover member molding machine to be a cover member 14 shown in FIGS. 11A and 11B, is prepared independently of the molding process in said cover member molding machine. The piece 120 has a predetermined outer shape corresponding to said predetermined circumferential shape of the opening 114*c* of the material placing flat part 114*c* (i.e., square with round corners). The size of said predetermined shape of the opening 114*c* is previously set larger than the size of said shape of the opening edge 116*a* of the sheet material holder 116.

In said cover member molding machine, the male mold 118 is upwardly isolated from the opening 114*c* of the material placing surface 114*a* of the female mold 114 fixed at said predetermined position not shown in the drawing in the workshop (not shown) as described above, and the sheet piece 120 is placed on the material placing surface 114*a* while the sheet material holder 116 is being isolated from the material placing surface 114*a* of the female mold 114.

In this time, the piece 120 is concentrically located with respect to the opening 114*c* of the material placing surface 114*a*, corresponding to said predetermined shape of the opening 114*c* (i.e., corresponding the four corners which are staged portions of said predetermined shape of the piece 120, to the four corners which are the staged portions of said predetermined shape of the opening 114*c*).

Next, press the piece 120 of the sheet material placed on the material placing surface 114*a* of the female mold 114 as mentioned above, to the sheet material holder 116, as shown in FIG. 14A. In this time, the sheet material holder 116 is aligned with the opening 114*c* of the material placing surface 114*a*, corresponding to said predetermined shape of the opening 114*c* (i.e., corresponding the four corners which are staged portions of said predetermined shape of the edge 116*a* of the opening of the sheet material holder 116, to the four corners which are the staged portions of said predetermined shape of the opening 114*c*). This state is shown in FIG. 14A.

In FIG. 14A a reference numeral 122 shows the end portion of the reciprocating member of the known reciprocating unit (not shown) which reciprocates vertically the male mold 118 between the isolated position shown in FIG. 14A and the position where the male mold 118 is inserted a predetermined depth into the opening 114*c* of the material placing surface 114*a* of the female mold 114 as described above.

Next, the male mold 118 makes contact and presses, by said reciprocating unit, the contact surface 118*b* to the small sheet 120 placed on the material placing surface 114*a* of the female mold 114 through the opening of the sheet material holder 116. In this time, the male mold 118 is concentrically located with respect to the opening 114*c* of the material placing surface 114*a*, corresponding to said predetermined shape of the opening 114*c* (i.e., corresponding the four corners which are staged portions of said predetermined shape of the contact surface 118*b* of the male mold 118, to the four corners which are the staged portions of said predetermined shape of the opening 114*c*).

When the male mold 118 is further pressed by said reciprocating unit, the male mold 118 pushes the sheet 120 being contacted with the contact surface 118*b* into the opening 114*c* of the flat part 114*c* through the entrance edge 114*d*.

Then, the part of the rectangular sheet 120 contacting with the contact surface 118*a* of the male mold 118 is made to be a flat part 14*a* having said predetermined shape of the cover member 14. The part of the sheet material 120 extruded from the contact surface 118*a* of the male mold 118 is pulled into the opening 114*c* of the female mold 114 in the entrance edge 114*d* of the opening 114*c* of the material placing surface 114*a* of the female mold 14, that is, in the periphery of the flat part 14*a*. This pulled-in part is held between inner circumference 114*b* of the opening 114*c* and the outer circumference 118*a* of the male mold 118 in the opening 114*c*, and carried in this state from the periphery of the flat part 14*a* toward a predetermined direction crossing the surface of the flat plate 14*a*, i.e., toward the entrance edge 114*d* of the opening 114*c*, along the inner circumference 114*b* of the opening 114*c*, and bent to be a bent peripheral bent portion 14*b*.

Figure 14B:
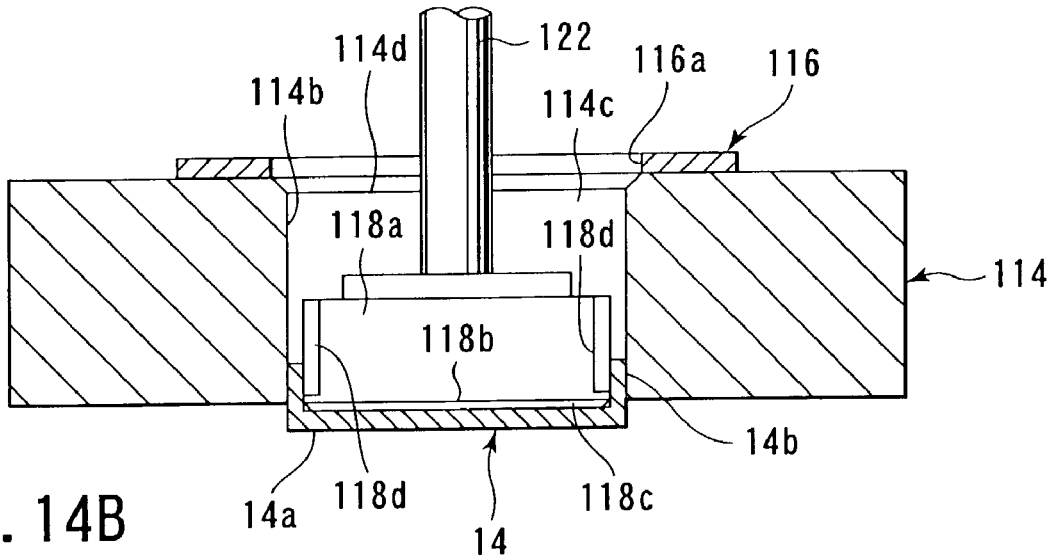
FIG. 14B is a schematic longitudinal sectional view showing the process immediately after a cover member molding machine made the cover member from the sheet material.

This state is shown in FIG. 14B, in which the cover member 14 shown in FIGS. 11 and 11B is molded.

As described above, while the piece 120 of the sheet material placed on the material placing surface 114*a* of the female mold 114 is being pushed into the opening 114*c* of the material placing surface 114*a* of the female mold 114 by the male mold 118, a tensile force is generated between the part of the sheet 120 pushed into the opening 114*c* of the material placing surface 114*a* of the female mold 14 by the male mold 118, and the part pressed by the sheet holder 116 onto the material placing surface 114*a* of the female mold 114.

Since the entrance edge 114*d* of the opening 114*c* of the material placing surface 114*a* is chamfered as well as the boundary edge 118*c* between the outer circumference 118*b* and contact surface 118*a* of the male mold 118 is chamfered, said tensile force is spread almost uniformly all over the part extruded from the contact surface 118*a* of the male mold 118 in the sheet 120. Thus, a wrinkle is not generated along the boundary between the surface of the side of the flat part 14*a* where the rim portion 14*b* is bent (i.e., outside surface) and the surface of the bent rim 14*b* facing the flat part 14*a*, even if the predetermined shape of the flat plate 14*a* of the cover member 14 has a square staged portion, for example. Further, even if the cover member 14 is a laminate, the above-mentioned wrinkle is not generated, a tear in the surface layer which may mix into said wrinkle does not occur, and a void is not generated in the laminated layers.

At least the staged portion (the corner in this example) 118*d* of the outer circumference 118*b* of the male mold 118 is a substantially straight line orthogonal to the contact surface 118*b* except the boundary edge 118*c* chamfered up to the position P which is separated from the contact surface 118*b* by the distance shorter than BL that is the bent length of the peripheral bent portion 14*b* of the cover member 14, and it is inclined inward along the contact surface 118*b* by an angle of $\alpha$ as it goes away from the contact surface 118*b* further from said position P. This prevents concentration of said tensile force on the position corresponding to said staged portion of the sheet 120 extruded from the contact surface 118*a* of the male mold 118. Thus, a wrinkle may be not generated at the position corresponding to said staged portion 118*d*. Further, even if the cover member 14 is a laminate, the above-mentioned wrinkle is not generated, a tear in the surface layer which may mix into said wrinkle does not occur, and a void is not generated in the laminated layers.

As described above, after being molded from the sheet 120, the end of the bent rim 14*b* quits from the opening 114*c* of the female mold 114 when the male mold 118 reaches the predetermined depth in the opening 114*c* of the material placing surface 114*a* of the female mold 114, and thereafter the cover member 14 is inserted into end of the cylindrical trunk member of the case through the opening, and fed to the process for closing this opening.

In the above-mentioned example, at least the staged portion (the corner in the above-mentioned example) 118*d* of the outer circumference 118*a* of the male mold 118 is a substantially straight line orthogonal to the contact surface 118*b* except the boundary edge 118*c* chamfered up to the position P which is separated from the contact surface 118*b* by the distance shorter than BL that is the bent length of the bent rim 14*b* of the cover member 14, and it is inclined inward along the contact surface 118*b* by an angle of a as it goes away from the contact surface 118*b* further from said position P.

Although being structured to be a substantially straight line orthogonal to the contact surface 118*b* all over the outer circumference 118*a* except the boundary edge 118*c* chamfered up to the position P which is separated from the contact surface 118*b* by the distance shorter than BL that is the bent length of the rim 14*b* of the cover member 14, and to be inclined inward along the contact surface 118*b* by an angle of a as it goes away from the contact surface 118*b* further from said position P, the same effect as that of the above-mentioned embodiment male mold 118 can be obtained.

Also, in the above-mentioned example, the predetermined shape of the flat part 14*a* of the cover member 14 and the shape of the outer circumference 118*a* of the male mold 118 corresponding to said shape is substantially square with the staged corner 14*c*, according to the philosophy of the present invention, the shape can be circular, elliptical, polygonal other than square or indefinite, but they should include a staged portion to become a convex or a concave.

Said cover member molding machine is a machine to mold from a sheet material a cover member which comprises a predetermined shape flat part and an outwardly extended rim bending from said flat part periphery to a predetermined direction crossing said flat part surface, closes the opening of the end of the main part of a cylindrical case when being inserted into the opening of said end, and is to be supported by the inner circumference of the end portion in said peripheral bent portion. However, even if said predetermined shape of said flat plate of said cover member has a square staged portion, for example, a wrinkle is not generated along the boundary between the surface of the side of said flat part where said rim is bent and the surface of said bent rim facing said flat part, or at the position of said bent rim corresponding to said staged portion of said flat part. Further, even if the cover member 14 is a laminate, the above-mentioned wrinkle is not generated, a tear in the surface layer which may mix into said wrinkle does not occur, and a void is not generated in the laminated layers.

Now, description will be given on an example of a method of fixing a cover member molded as explained above to a trunk member with reference to FIGS. 15A to 15H.

Figure 15A:
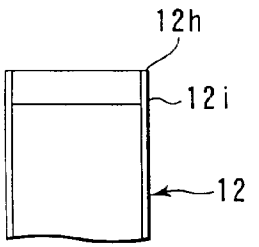
FIGS. 15A through 15I are views explaining an example of a method of fixing the cover member to the trunk member.

Here, a trunk member is the same as the above-mentioned trunk member 14 except that a sealing tape 20 is omitted. For simplified explanation, an opening to be closed by a cover member is denoted by a reference numeral 12*h*, and an end portion having this opening is denoted by a reference numeral 12*i*, as shown in FIG. 15A.

Figure 15B:
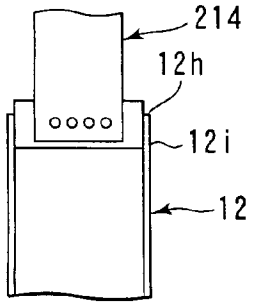

First, as shown in FIG. 15B, insert a known heating means 214 into one end portion 12*i* of a cylindrical trunk member 12 through an opening 12*h*, and heat a sealant or a heat-sensitive adhesive function part provided inside of the one end. This heating should be made to activate said heat-sensitive adhesive function part. The known heating means 214 mentioned here comprises a high-temperature air ejector. The air is heated to 70° C. to 80° C.

When an article is already loaded in the inner space of the cylindrical trunk member 12 and heating of this article is not preferable, the heating process can be omitted.

Figure 15C:
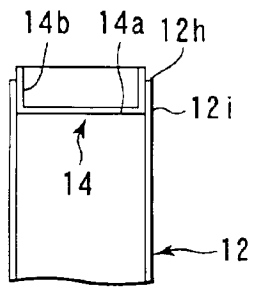

Next, insert the cover member 14 with a flat part 14*a* first into the end portion 12*i* through the opening 12*h* of the cylindrical trunk member 12, so that the flat part 14*a* closes the opening 12*h* and the outer circumference of the bent rim 14*b* comes in contact with the inner circumference of the end portion 12*i*, as shown in FIG. 15C.

Figure 15D:
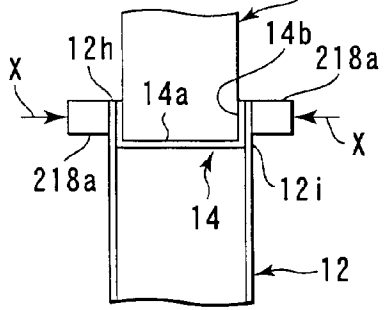

Next, insert the heated inside heating mold member 216 into the cover member 14, as shown in FIG. 15D. The shape of this inside heating mold member 216 is the same as the opening 12*h*, but the dimensions are a little smaller. Namely, the inside heating mold member 216 is set so that its outer circumference comes in contact with almost whole inner circumference of the rim 14*b* of the cover member 14. This heating member is heated by a known heating means up to a temperature necessary to activate the heat-sensitive adhesive function part.

Next, push the end portion 12*i* of the trunk member from the outside by two kinds of outside mold members, i.e., outside mold member intermediate parts 218*a* and outside mold member corner parts 218*b*, so that these parts 218*a*. 218*b* and the inside heating mold member 216 fix the adhesive part of the rim 14*b* of the cover member 14 to the heat-sensitive adhesive function part of the end portion 12*i* of the trunk member 12 by gluing and sealing, as shown in FIGS. 15D, 15E, 15F and 15G.

Figure 15E:
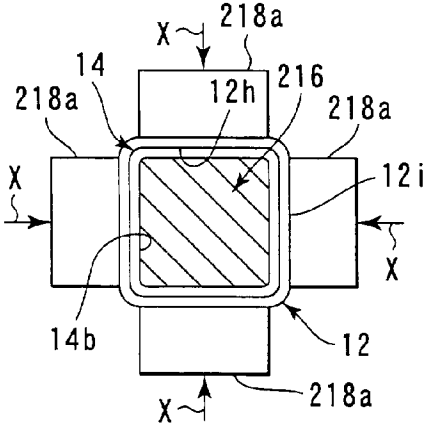
Figure 15F:
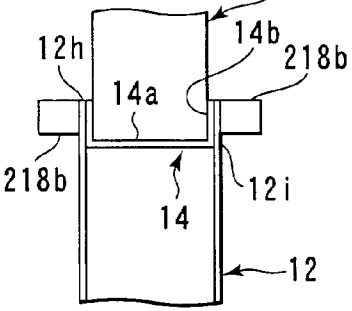
Figure 15G:
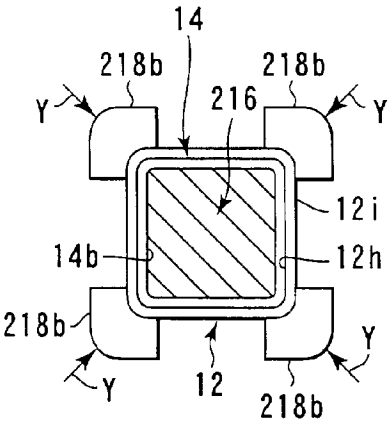

Said outside mold member intermediate parts 218*a* respectively correspond to a plurality of sides forming the outer circumference of the end portion of the trunk member, as shown in FIG. 15E. Said outside mold member intermediate parts 218*b* respectively corresponds to the corners between the sides, as shown in FIG. 15G. In the above-mentioned embodiment case, the trunk member is rectangular, and there are four intermediate parts 218*a* corresponding to the four sides of the case, and there are four corners 218*b* corresponding to the four corners.

Said outside mold member intermediate part 218*a* and outside mold member intermediate part 218*b* are set so that they are operated independently of each other. The four intermediate parts 218*a* press the sides of the end portion 12*i* to the heating member 216 as indicated by the arrow X. As a result, each intermediate part 218*a* cooperates with the inside heating mold member 216, holds the side wall of the cylindrical end portion 12*i* and the side wall of the rim 14*b* of the cover member 14, and melts them by heating and secures them by sealing them. Thereafter, the intermediate part 218 is moved in the direction reverse to the arrow direction, and instead each corner part 218*b* is moved in the arrow Y direction to press the corner of the end portion 12*i*. As a result, each corner part 218*b* cooperates with the inside heating mold member 216, holds the corner wall of the end portion 12*i* and the corner wall of the rim 14*b* of the cover member 14, and secures them by sealing them by heating the inside heating mold member 216.

If the heat-sensitive adhesive function part is not sufficiently activated by heating the inside heating mold member 216, the outside mold member intermediate part 218*a* and the outside mold member corner part 218*b* can be heated by a known heating means up to a temperature to activate the heat-sensitive adhesive function part.

Figure 15H:
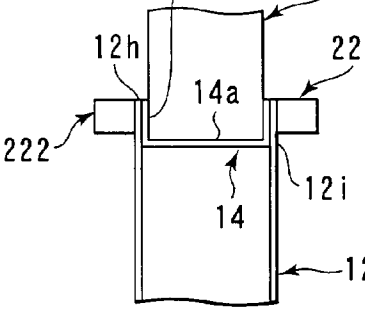
Figure 15I:
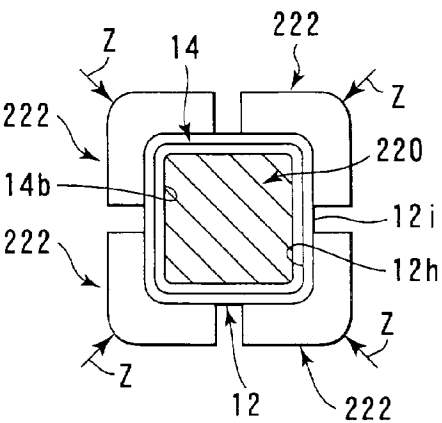

Next, move said outside mold member corner part 218*b* in the direction reverse to the arrow, to separate it from the trunk member, and insert the inside mold cooling member 220 into the cover member 14, as shown in FIGS. 15H and 15I. It is preferable that at least the part of the inside mold cooling member 220 to be inserted into the cover member has substantially the same shape and dimensions as those of said inside heating mold member 216.

Further, press almost all over the outside of end portion 12*i* of the trunk member 12 by the outside mold cooling members 222 as indicated by the arrow Z, hold the end portion 12*i* of the trunk member and the rim 14*b* of the cover member by the outside mold cooling member 222 and the inside mold cooling member 220, take them out, stabilize said sealing quickly, and increase the strength of said sealing.

The outside mold cooling member 222 presses the end portion 12*i* in the direction diagonal to the opening 12*h* as indicated by the arrow Z, to complete the sealing of said adhesive part of the rim 12*b* of the cover member 14 with respect to said heat-sensitive adhesive function parts of the four corners of the end portion 12*i*.

When the cross section of the opening 12*h* is polygonal except square, the outside mold cooling member 222 preferably presses each corner of the polygon inwardly into the opening 12*h*. This will ensure the sealing of said adhesive part of the rim 14*b* of the cover member 14 with respect to said heat-sensitive adhesive function part of each corner of the polygon except square of the area 12*i* in the proximity of the opening of the inner circumference of the trunk member 12.

The thermal capacity of said outside mold cooling member 222 and the inside mold cooling member 220 is preferably large. They can be positively cooled by various known cooling means. If the purpose of stabilizing rapidly said sealing and increasing its strength is attainable, the cooling members may be held non-heated or may not be positively cooled by a known cooling means.

If the strength of said sealing can be set to a desired level, the cooling of said sealing (i.e., the process of stabilizing the sealing) by the cooling members 222, 220 shown in FIGS. 15H and 15I can be omitted.

After, close the opening of the first end portion of the trunk member by the first cover member 14, as described above, reverse the trunk member so that the second end portion is faced up, put a product in the trunk member as stated before, and close the opening of the second end portion of the trunk member by the second cover member, by the same process as for the first cover member, thereby completing a sealed case.

Though not have been explained heretofore, it will be apparent to those skilled in the art that said cover molding process and cover fitting process could be performed continuously and mass-productively.

From the above description, it will be apparent to those skilled in the art that the invention disclosed herein provides a sealed case with excellent rigidity even by using relatively thin material or a blank.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sealed case, comprising:

an elongated trunk member including an overlapped part made by overlapping at least parts of an inside end portion and an outside end portion apart from each other in a vertical axis direction of a sheet material having a vertical axis and a horizontal axis crossing the vertical axis, and first and second open portions each provided with an opening and apart from each other in a horizontal axis direction, and said overlapped portion having a fixing area to fix the inside and outside end portions;

first and second cover members made of sheet material and fixed to said first and second open end portions of the trunk member, closing the openings of said open end portions; and a tongue member which is provided at said outside end portion of the trunk member and exposed to an outside, and when a tensile force is applied, releases the fixing of the outside and inside end portions and partially releases the fixing of said first and second open end portions and said first and second cover members, thereby unsealing the sealed case;

each of said first and second cover members including a main part having the substantially same shape and size as that of the cross section of the opening of the trunk member, the main part having an outer surface and a peripheral end face and a ring-shaped rim projected from the outer surface of the main part and extended along the peripheral end face of the main part, the rim having an outer peripheral surface; and the main part of the cover member being located in each end portion of the trunk member, and the outer peripheral surface of said rim of the cover member is attached to an inside surface of the end portion in a surface contact manner.

2. The sealed case according to claim 1, further comprising a sealing tape which covers an end-face of the inside portion of the trunk member and an area in the proximity thereof.

3. The sealed case according to claim 2, wherein each of the sheet materials forming said trunk member and said cover members is made of a material having at least one of light-shield and air-tightness properties.

4. The sealed case according to claim 2, wherein the sealing tape is provided along an entire length of the end-face of the inside portion of the trunk member and along the area in the proximity of the end-face.

5. The sealed case according to claim 1, wherein each of the sheet materials forming said trunk member and said cover members is made of a material having at least one of light-shield and air-tightness properties.

6. The sealed case according to claim 1, wherein said tongue member is integral with the material forming said trunk member, and projects outward from one end of said outside end portion of the material.

7. The sealed case according to claim 1, wherein said trunk member has a slit which extends along the horizontal axis of the material and through which a tip of the tongue member is inserted into the trunk member, and after the case is unsealed, said tip of the tongue member is inserted through said slit, thereby re-sealing the case.

8. The sealed case according to claim 7, further comprising a moisture-proof film fit to an inside of the trunk member so as to cover said slit.

9. The sealed case according to claim 1, wherein said moisture-proof film is located between said first and second end portions, and has the same width as the distance therebetween; and both ends along the moisture-film extending direction are attached to the inside of the trunk member.

10. The sealed case according to claim 1, wherein said rim projects at an angle of 90° from the main part.

11. The sealed case according to claim 1, wherein the cross section of the trunk member is square, polygonal, circular, or elliptical.

12. A sealed case, comprising:

an elongated trunk member including an overlapped part made by overlapping at least parts of an inside end portion and an outside end portion of apart from each other in a vertical axis direction of a sheet material having a vertical axis and a horizontal axis crossing the vertical axis, and first and second open portions each provided with an opening and apart from each other in a horizontal axis direction, and said overlapped portion having a fixing area to fix the inside and outside end portions;

first and second cover members made of sheet material and fixed to said first and second open end portions of the trunk member, closing the openings of said open end portions; and a tongue member which is provided at said outside end portion of the trunk member and exposed to an outside, and when a tensile force is applied, releases the fixing of the outside and inside end portions and partially releases the fixing of said first and second open end portions and said first and second cover members, thereby unsealing the sealed case;

each of said first and second cover members including a main part having the substantially same shape and size as that of the cross section of the opening of the trunk member, and a rim provided in a circumference of the main part; and the main part of the cover member being located in each end portion of the trunk member, and said rim of the cover member is fixed to an inside surface of the end portion in a surface contact manner, wherein said fixing area partially projects so that a part corresponding to the tongue member comes close to the tongue member.

13. The sealed case according to claim 12, wherein each of the sheet materials forming said trunk member and said cover members is made of a material having at least one of light-shield and air-tightness properties.

14. The sealed case according to claim 12, wherein the cross section of the trunk member is square, polygonal, circular, or elliptical.

* * * * *